US011167962B2

(12) United States Patent
Weckbecker et al.

(10) Patent No.: US 11,167,962 B2
(45) Date of Patent: Nov. 9, 2021

(54) CRANE HAVING A COUNTERWEIGHT ADJUSTMENT DEVICE, AND METHOD FOR ADJUSTING A COUNTERWEIGHT ON A CRANE

(71) Applicant: Tadano Demag GmbH, Zweibrücken (DE)

(72) Inventors: Alfons Weckbecker, Zweibrücken (DE); Martin Zwifka, Beilstein (DE); Thorsten Helwes, Homburg (DE); Fritz-Botho Köster, Rockenhausen (DE)

(73) Assignee: Tadano Demag GmbH, Zweibrücken (DE)

( * ) Notice: Subject to any disclaimer, the term of this patent is extended or adjusted under 35 U.S.C. 154(b) by 256 days.

(21) Appl. No.: 16/315,505

(22) PCT Filed: Jul. 5, 2017

(86) PCT No.: PCT/EP2017/066744
§ 371 (c)(1),
(2) Date: Jan. 4, 2019

(87) PCT Pub. No.: WO2018/007433
PCT Pub. Date: Jan. 11, 2018

(65) Prior Publication Data

US 2019/0315607 A1 Oct. 17, 2019

(30) Foreign Application Priority Data

Jul. 8, 2016 (DE) ..... 102016212517.6

(51) Int. Cl.
*B66C 23/76* (2006.01)
*B66C 23/36* (2006.01)

(52) U.S. Cl.
CPC ..... *B66C 23/76* (2013.01); *B66C 23/36* (2013.01); *B66C 2700/0371* (2013.01)

(58) Field of Classification Search
CPC ..... B66C 23/36; B66C 23/62; B66C 23/72; B66C 23/74; B66C 23/76; B66C 2700/0371; E02F 9/18; B62D 49/085
See application file for complete search history.

(56) References Cited

U.S. PATENT DOCUMENTS 3,726,416 A 4/1973 Pottorff et al.
4,729,486 A * 3/1988 Petzold ..... B66C 23/76 212/197

(Continued)

FOREIGN PATENT DOCUMENTS

CN 101309850 A 11/2008
CN 201292224 Y 8/2009

(Continued)

OTHER PUBLICATIONS

Preliminary Report on Patentability of the International Searching Authority in English from corresponding Patent Cooperation Treaty (PCT) Application No. PCT/EP2017/066744, completed Jan. 8, 2019.

(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A crane having an undercarriage, a superstructure pivotable about a slewing axis relative to the undercarriage, a counterweight unit and a counterweight adjustment device. The counterweight adjustment device includes a telescopic frame which is fastened to the superstructure and has a telescopic longitudinal member, a counterweight unit (Continued)

arranged to be displaceable along the frame, a drive unit for displacing the counterweight unit and a kinematic unit to telescope the frame in a driven manner. A jetty is fastened to a rear end, remote from the slewing axis, of the longitudinal member, the counterweight unit is displaceable along the frame in the region of the superstructure as far as the jetty, the counterweight unit is able to be fastened to the jetty and the counterweight unit is able to be telescoped in and out on the jetty with the frame.

13 Claims, 19 Drawing Sheets

(56) References Cited

U.S. PATENT DOCUMENTS

| | | | | |
|---|---|---|---|---|
| 6,568,547 | B1 * | 5/2003 | Kretschmer | B66C 23/76 212/196 |
| 2011/0031202 | A1 * | 2/2011 | Pech | B66C 23/76 212/178 |
| 2013/0098860 | A1 | 4/2013 | Pech et al. | |
| 2013/0161278 | A1 | 6/2013 | Sun et al. | |
| 2015/0210514 | A1 * | 7/2015 | Albinger | B66C 23/76 212/279 |
| 2015/0210515 | A1 * | 7/2015 | Pech | B66C 23/76 212/197 |
| 2016/0090278 | A1 * | 3/2016 | Willim | B66C 23/36 212/197 |

FOREIGN PATENT DOCUMENTS

| | | | |
|---|---|---|---|
| CN | 101643182 | A | 2/2010 |
| CN | 102020210 | A | 4/2011 |
| CN | 105460799 | A | 4/2016 |
| DE | 202014007894 | U1 | 10/2014 |
| EP | 0368463 | B1 | 7/1994 |
| EP | 2829500 | A3 | 3/2015 |
| GB | 2442139 | A | 3/2008 |
| JP | 2000198674 | A | 7/2000 |
| JP | 3180204 | B2 | 6/2001 |
| JP | 2005138962 | A | 6/2005 |
| JP | 2011037634 | A | 2/2011 |
| RU | 2010108363 | A | 9/2011 |

OTHER PUBLICATIONS

International Search Report of the International Searching Authority from corresponding Patent Cooperation Treaty (PCT) Application No. PCT/EP2017/066744, indicated completed on Sep. 26, 2017.

Written Opinion of the International Searching Authority from corresponding Patent Cooperation Treaty (PCT) Application No. PCT/EP2017/066744, indicated completed on Sep. 26, 2017.

* cited by examiner

CRANE HAVING A COUNTERWEIGHT ADJUSTMENT DEVICE, AND METHOD FOR ADJUSTING A COUNTERWEIGHT ON A CRANE

CROSS REFERENCE TO RELATED APPLICATIONS

The present application claims priority benefits of International Patent application No. PCT/EP2017/066744, filed Jul. 5, 2017, and claims benefit of German patent application DE 102016212517.6, filed Jul. 8, 2016.

BACKGROUND OF THE INVENTION

The invention relates to a crane having a counterweight adjustment apparatus and to a method for adjusting a counterweight on a crane.

US 2013/0 161 278 A1 discloses the displacement of a counterweight by means of a hydraulic cylinder on a crane superstructure. The displacement path, i.e. the adjustable counterweight radius, is restricted and dependent in particular upon the operating displacement of the hydraulic cylinder.

In order to displace the counterweight beyond the crane superstructure, it is necessary in accordance with US 2013/098860 A1 to transfer the counterweights to a telescopic counterweight support beam. In accordance with DE 20 2014 007 894 U1, a telescopic frame can be extended by means of a separate drive.

British patent application GB 2 442 139 A relates to a camera crane comprising a telescopic arm and a counterweight arrangement which comprises a displaceable counterweight support beam in order to compensate for the movements of the camera and to prevent the camera crane from toppling over.

Patent EP 0 368 463 B1 relates to a crane comprising a counterweight support arm, on which a received counterweight can be moved by means of a counterweight support beam. The counterweight support arm is extendible and consists of a multiplicity of connected segments. By connecting the segments, two positions of the counterweight support arm can be adjusted and then the counterweight can be moved along the counterweight support arm.

SUMMARY OF THE INVENTION

The object of the present invention is to improve the options for adjusting a counterweight on a crane, wherein in particular the outlay for adjustment of the counterweight is to be reduced.

In accordance with an embodiment of the invention, this object is achieved by means of a crane having a counterweight adjustment apparatus.

In accordance with another embodiment of the invention, it has been recognised that a crane comprising a lower carriage, a superstructure, which can be pivoted about an axis of rotation with respect to the lower carriage, a counterweight unit and a counterweight adjustment apparatus comprises a telescopic framework which is fastened to the superstructure and has a telescopic longitudinal member, a counterweight unit which is arranged so as to be displaceable along the framework, a drive unit for displacing the counterweight unit in a driven manner on the framework, and a kinematic unit which can be coupled to the drive unit in order to telescope the framework in a driven manner, wherein a cantilever element is fastened to a rear end of the longitudinal member remote from the axis of rotation, the counterweight unit can be displaced along the framework in the region of the superstructure as far as onto the cantilever element, the counterweight unit can be fastened to the cantilever element and the counterweight unit can be telescoped inwards and outwards on the cantilever element with the framework. In particular, an additional drive unit for telescoping the framework is not required. In particular, only a single drive unit is provided. In particular, it is possible to combine the entire counterweight of a crane, i.e. in particular a central ballast, a superstructure counterweight and a superlift counterweight, into one counterweight and to arrange same on the superstructure of the crane. This increases efficiency in terms of counterweight displacement. The counterweight displacement apparatus permits effective counterweight displacement. In particular, additional counterweights are not required. The adjustment of the counterweight is improved. A counterweight unit is arranged in a displaceable manner on a framework. The framework is telescopic. By telescoping the framework, it is possible to additionally displace the counterweight, in particular together with the telescoped part of the framework. In particular, the counterweight adjustment is effected in two stages. In a first stage, the displacement of the counterweight unit is effected on the framework, in particular to an end position on a cantilever element. In particular, in the first stage the framework is not telescoped. In a second stage, the displacement of the counterweight is effected by telescoping the framework. The counterweight unit can be designed having multiple parts and in particular can have a plurality of counterweight elements which, in particular, are stacked one above the other and which, in particular, are two-dimensional. The counterweight unit can also have two stacks of counterweight elements which are arranged next to one another, in particular spaced apart from one another. The counterweight unit can be displaced starting from a minimum counterweight radius, which amounts in particular to 0, to a maximum counterweight radius. The minimum counterweight radius can also be negative. This means that the counterweight is arranged on the superstructure between the axis of rotation and the jib. The displacement is effected exclusively by means of the drive unit. The counterweight radius is defined as the radial distance from an axis of rotation, in relation to which a superstructure is arranged in a rotatable manner on a lower carriage of a crane. The counterweight adjustment apparatus ensures that the entire range of the adjustable counterweight radius remains usable in order to adapt the position of the counterweight unit to the requirements arising from a crane configuration and a loading. The stability of the crane towards the rear is retained even with an increased superstructure counterweight because the superstructure counterweight is displaceably mounted. Improved mass distribution, in particular with and without a load on the crane, improves the introduction of force into the ground via the crane lower carriage. The counterweight adjustment apparatus increases the flexibility of use of the crane, in particular with regard to its manoeuvrability. By reason of the fact that the entire counterweight can be arranged in the counterweight unit on the superstructure of the crane, the crane can be moved at any moment during a lift and the superstructure can be rotated with respect to the lower carriage.

A guide unit permits advantageous displacement of the counterweight unit on the framework. The guide unit can be e.g. an, in particular, linear guide rail which is arranged in particular on a top side of the longitudinal member. A driven displacement element of the drive unit can be linearly displaced along the guide rail. The guided displacement of the counterweight unit is effected indirectly by the driven displacement of the displacement element which can be coupled to the counterweight unit.

Alternatively, the guide unit, in particular as a component of the drive unit, can be designed in the form of a force transmission element, in particular in the form of a circulating roller chain, to which the counterweight unit can be coupled and thus displaced in a guided manner.

Fastening the counterweight unit to the cantilever element according to claim 1 ensures secure displacement of the counterweight unit during telescoping of the framework.

A longitudinal member ensures reliable and multiple telescoping in order to achieve larger counterweight radii with the smallest possible basic length of the crane, in particular of the crane superstructure. In particular, the longitudinal member comprises an outer basic box and at least one telescoping element arranged therein, in particular a first telescoping element and a second telescoping element which is arranged in the first telescoping element. It is also possible to have telescoping elements which are arranged nested inside one another a number of times, so-called inner boxes. In particular, the basic box and the inner boxes have mutually similar contours. In particular, the contours are rectangular. Other cross-sectional contours are also feasible.

An embodiment comprising two longitudinal members permits an advantageous arrangement of the counterweight adjustment apparatus symmetrical to the superstructure longitudinal axis. A free space arranged between the longitudinal members permits integration of the counterweight adjustment apparatus on the superstructure of the crane, said integration being advantageous because it saves space. Functional components of the crane, such as an A-bracket, jib and/or cable winches, can be arranged in the free space. In particular, the framework is arranged with a longitudinal axis in parallel with the superstructure longitudinal axis. In particular, the longitudinal axis of the framework and the superstructure longitudinal axis are arranged on a common vertical plane which contains in particular the axis of rotation, in relation to which the crane superstructure is arranged in a rotatable manner on the crane lower carriage.

A locking unit permits defined locking of the counterweight unit on the cantilever element, in particular during telescoping of the framework. The locking unit can have a locking element of the counterweight unit and a locking counter-element of the cantilever element. The locking element and the locking counter-element can be locked together in particular in an uncomplicated and time-saving manner. In particular, they are corresponding plates which can be locked by means of a bolt.

Dividing the entire counterweight of the crane into the counterweight unit and an additional cantilever element counterweight permits a reduction in the counterweight unit, i.e. a reduction in the mass and/or volume, in particular height, of the counterweight unit. As a result, the height of the centre of mass of the counterweight adjustment apparatus can be reduced. The height of the centre of mass of the crane is reduced. It is possible to displace the crane, in particular the superstructure, in a more stable manner. In addition, it is possible to dimension the framework and in particular the longitudinal member, to be smaller. The construction size is reduced. The additional cantilever element counterweight is anchored in particular to an underside of the cantilever element.

A displacement element permits uncomplicated displacement of the counterweight unit. The counterweight unit can be coupled directly to the displacement element and can be displaced along the guide unit.

An embodiment of the kinematic unit ensures advantageous coupling of the at least one telescoping element to the displacement element by means of a cable winch system. In particular, the cable winch system is a circulating, closed cable winch system. The cable winch system comprises a first extension cable and a first return cable which are connected, in particular, to one another.

A second cable winch system simplifies the multiple telescoping capability of the framework. The second cable winch system has, in particular, an open design and has a second extension cable and a second return cable. The second cable winch system comprises an extension cable deflecting roller and a return cable deflecting roller which are each fastened to the telescopic telescoping element of the longitudinal member.

In an alternative embodiment of the drive unit, it is possible to directly couple the drive unit to the counterweight unit. The drive unit comprises a rotatably driven rotating element and a force transmission element which cooperates therewith and is designed in particular as a circulating roller chain. The circulating roller chain can be used directly to displace the counterweight unit.

Displaceability of the rotating element permits an arrangement of the rotating element in different positions. In a first position, the rotating element cooperates with the first force transmission element directly for displacing the counterweight unit.

In the first position, the rotating element is not in engagement with the kinematic unit. By displacing the rotating element in a coupling direction which is oriented perpendicularly to the axis of rotation of the rotating element, the rotating element is displaced to a second position. In the second position, the rotating element is in engagement with the kinematic unit for telescoping the framework. In the second position, the rotating element is not in engagement with the first force transmission element.

A second force transmission element permits an advantageous telescoping capability of the longitudinal member.

A method permits advantageous displacement of the counterweight unit on the crane.

Further advantageous embodiments, additional features and details of the invention will be apparent from the following description of exemplified embodiments with reference to the drawings.

DESCRIPTION OF THE PREFERRED EMBODIMENTS

Figure 1:
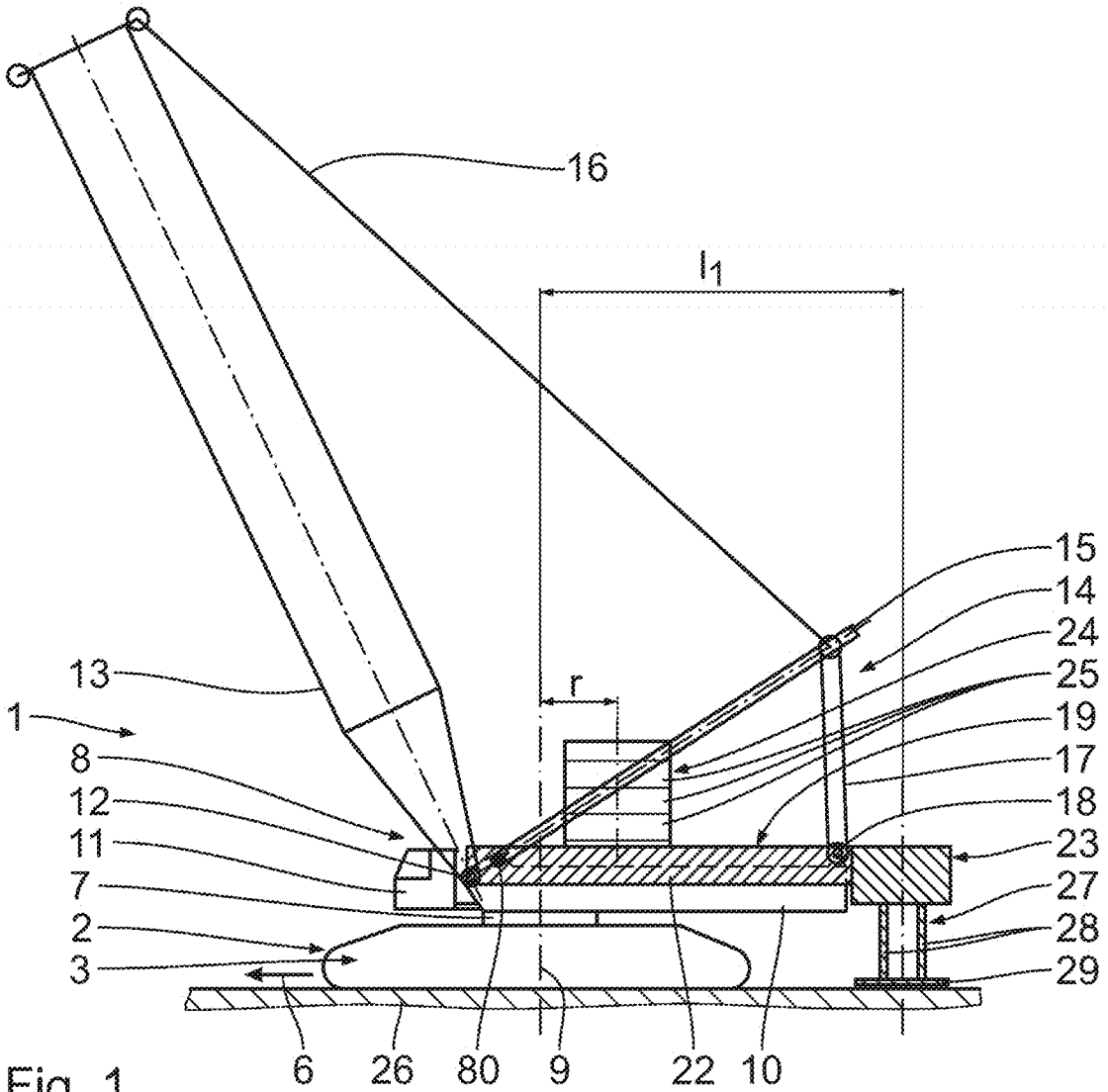
FIG. 1 shows a schematic side view of a crane according to a first embodiment comprising a counterweight adjustment apparatus in a non-telescoped arrangement.

A crane 1 shown in FIGS. 1 to 4 is a crawler crane. The crane 1 is a mobile crane. The crane 1 has a lower carriage 2 with a crawler track 3. The crane 1 is supported on ground 26 by means of the lower carriage 2. Instead of the crawler track 3, the crane 1 can also have a roadway running gear unit. The lower carriage 2 has a middle part 4, to which a crawler support 5 is fastened on each side. The crawler supports 5 are oriented in parallel with a travel direction 6 imposed by the crawler track 3.

A superstructure 8 is arranged on the lower carriage 2 in such a manner as to be rotatable about a vertical axis of rotation 9 by means of a rotary connection 7. The superstructure 8 has a superstructure frame 10. A cabin 11 for a crane operator is fastened to the superstructure frame 10. A main jib 13 is articulated to the superstructure frame 10 so as to be able to pivot about a jib axis 12. A bracing unit 14 for the main jib 13 is arranged on the superstructure frame 10. The bracing unit 14 comprises a bracing bracket 15 which is pivotably articulated to the superstructure 8, a bracing cable 116 for bracing the main jib 13 to the bracing bracket 15 and a cable mechanism 17 for changing the angle of the bracing bracket 15 or the main jib 13. The cable mechanism 17 is guided via a cable pulley 18 which is rotatably mounted on the superstructure 8.

The superstructure 8 has a superstructure longitudinal axis 21. The superstructure frame 10 is symmetrical with respect to the superstructure longitudinal axis 21. The superstructure frame 10 is arranged symmetrically with respect to the superstructure longitudinal axis 21. In relation to the axis of rotation 9, the superstructure frame is fastened in a non-rotationally symmetrical manner to the rotary connection 7. The cabin is 11 is arranged on a front end of the superstructure frame 10. The pivot axis 12 with the articulated main jib 13 is arranged on the front end of the superstructure frame 10. The front end of the superstructure frame 10 terminates substantially flush with the rotary connection 7. It is also feasible for the superstructure 10 to protrude with the front end at the rotary connection 7 along the superstructure longitudinal axis 21.

At a rear end opposite the front end, the superstructure frame 10 protrudes along the superstructure longitudinal axis 21 at the rotary connection 7. In particular, the superstructure frame 10 protrudes with the rear end to such an extent that, in an arrangement shown in FIG. 3 in which the superstructure longitudinal axis 21 is oriented in parallel with the travel direction 6, said superstructure frame protrudes at the crawler supports 5.

A counterweight adjustment apparatus 19 is arranged on the superstructure 8. The counterweight adjustment apparatus 19 comprises a telescopic framework 20 which is designed in the manner of a frame and is fixedly connected to the superstructure 8 and in particular can be fastened to the superstructure frame 10. A rotation of the superstructure 8 about the axis of rotation 9 automatically produces a rotational movement of the counterweight adjustment apparatus 19. In the plan view shown in FIGS. 3, 4, the framework 20 is formed substantially as an open rectangular profile.

The counterweight adjustment apparatus 19 is articulated to the superstructure 8 at a front end facing the cabin 11 in such a manner as to be rotatable on the superstructure about an axis of rotation 80 in parallel with the pivot axis 12. At a rear end arranged opposite the front end, the counterweight adjustment apparatus 19 is rigidly coupled to the superstructure 8. This blocks a rotation about the axis of rotation 80.

The framework 20 has two telescopic longitudinal members 22 which are fastened to a cantilever element 23 at the rear end remote from the axis of rotation 9. The two longitudinal members 22 are connected to one another via the cantilever element 23. The cantilever element 23 can be supported on the ground 26 by means of a support device 27. The support device 27 comprises at least one, preferably height-adjustable, vertical support 28 and at least one base plate 29 connected thereto.

A counterweight unit 24 is arranged on the framework 20. The counterweight 24 comprises two counterweight stacks which are spaced apart from one another in relation to the superstructure longitudinal axis 21. Each counterweight stack has a plurality of two-dimensional counterweight elements 25 which are stacked on top of one another. In the arrangement shown in FIG. 1, the counterweight unit 24 is arranged on the framework 20 and has a counterweight radius r. The counterweight radius r is defined as the radial distance between the counterweight unit 24 and the axis of rotation 9. The counterweight unit 24 can be displaced along the framework 20 between the minimum counterweight radius $r_{min}$ to $r_{max}=l_1$. The minimum counterweight radius $r_{min}$ is e.g. 0 if the counterweight unit is arranged concentrically with respect to the axis of rotation 9. The minimum counterweight radius $r_{min}$ can also be negative if the counterweight unit 24 is arranged between the axis of rotation 9 and the main jib 13 on the superstructure 8. The length h corresponds substantially to the distance between the axis of rotation 9 and the rear end of the framework 20 plus half the length of the cantilever element 23, as shown in FIG. 1.

Figure 2:
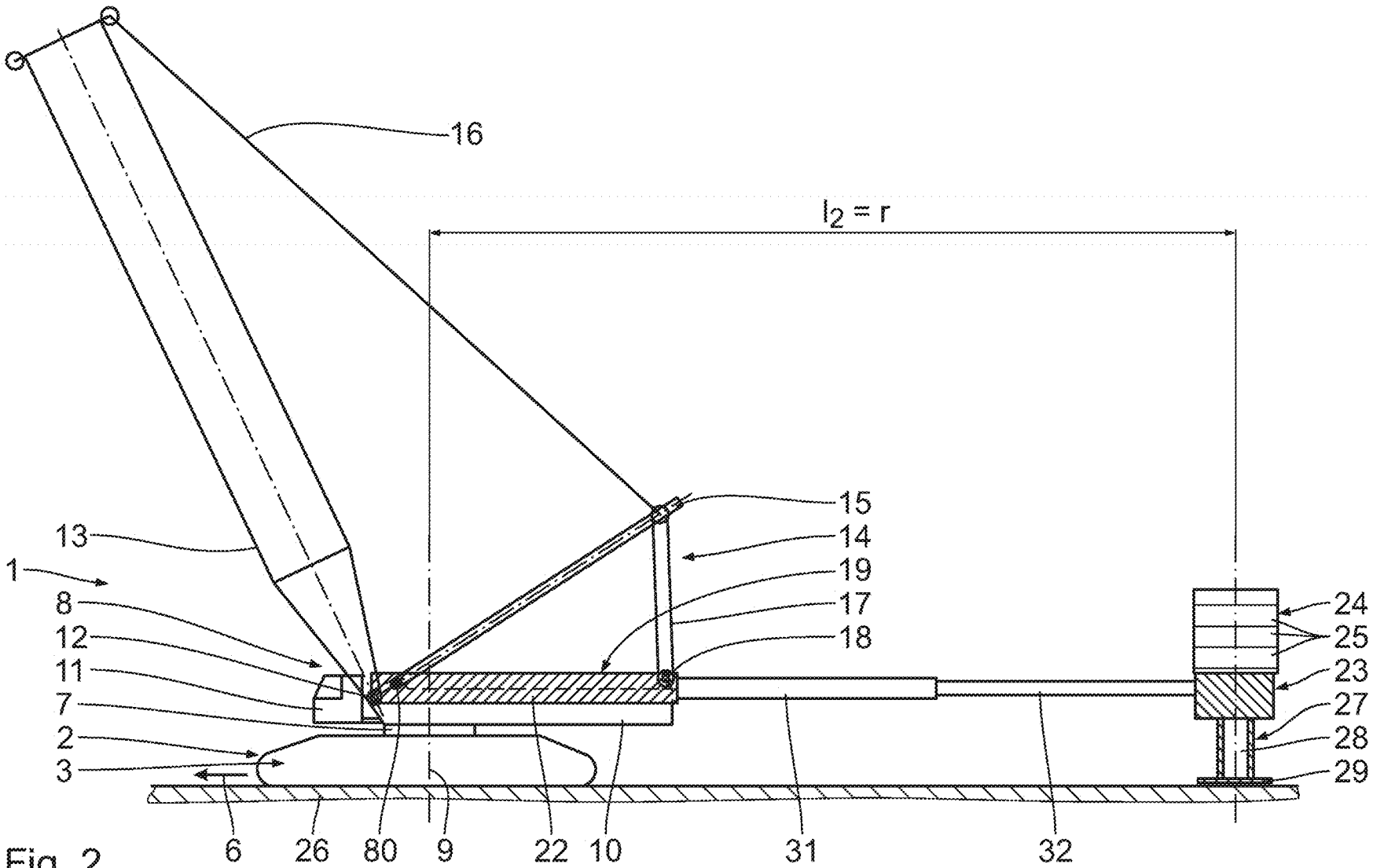
FIG. 2 shows a view, corresponding to FIG. 1, of the counterweight adjustment in a telescoped arrangement.
Figure 3:
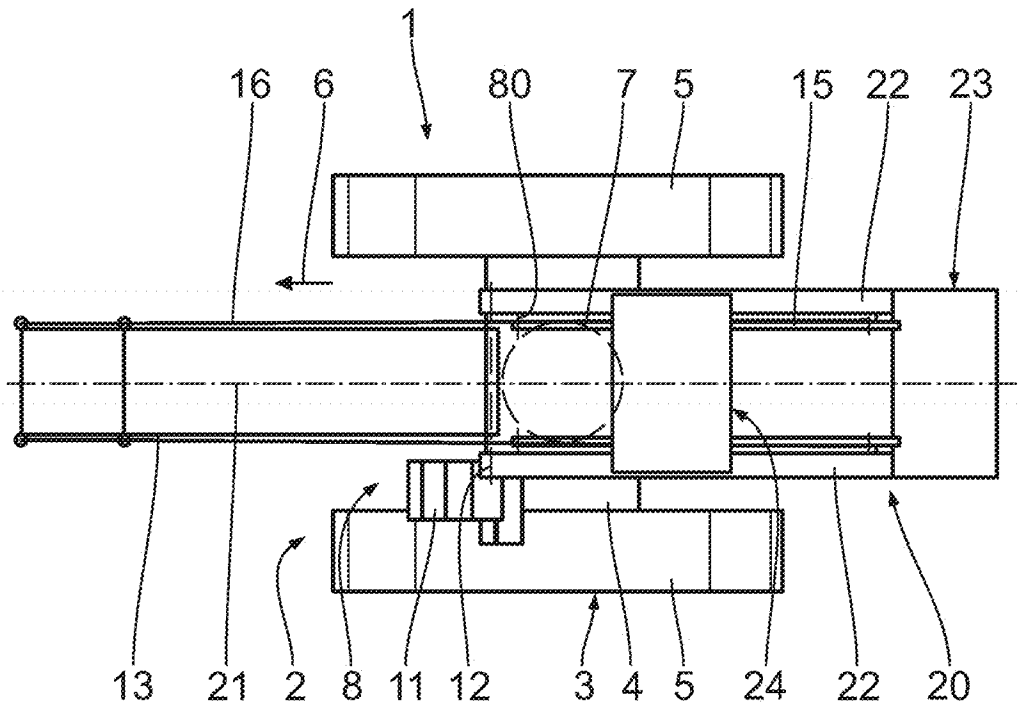
FIG. 3 shows a schematic plan view of the crane shown in FIG. 1.
Figure 4:
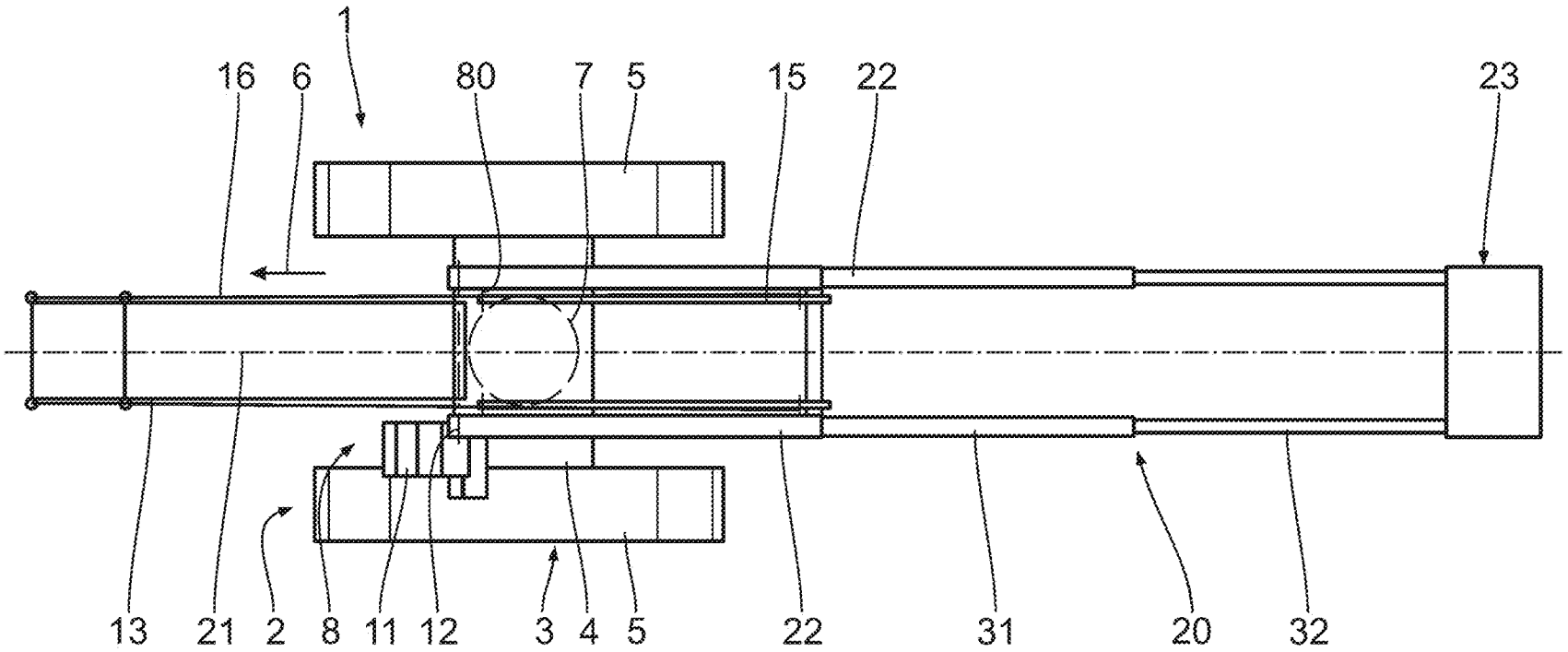
FIG. 4 shows a schematic plan view of a crane in a telescoped arrangement.

In the arrangement shown in FIG. 2, the framework 20 is telescoped a maximum of twice. The counterweight unit 24 is arranged on the cantilever element 23. In this arrangement shown in FIG. 2, the counterweight unit 24 is arranged with a maximum counterweight radius $r_{max}$ in relation to the axis of rotation 9. The counterweight elements 25 are stacked on a counterweight element carriage 62 which can be rolled by means of wheels 63 or rollers on the top side 34 of the basic box 30.

The counterweight adjustment apparatus 19 has a drive unit, not illustrated in greater detail in FIGS. 1 to 4, in order to displace the counterweight unit 24 on the framework 20 in a driven manner.

The counterweight adjustment apparatus 19 has a kinematic unit, not illustrated in greater detail in FIGS. 1 to 4, which can be coupled to a drive unit in order to telescope the framework 20 in a driven manner.

Figure 5:
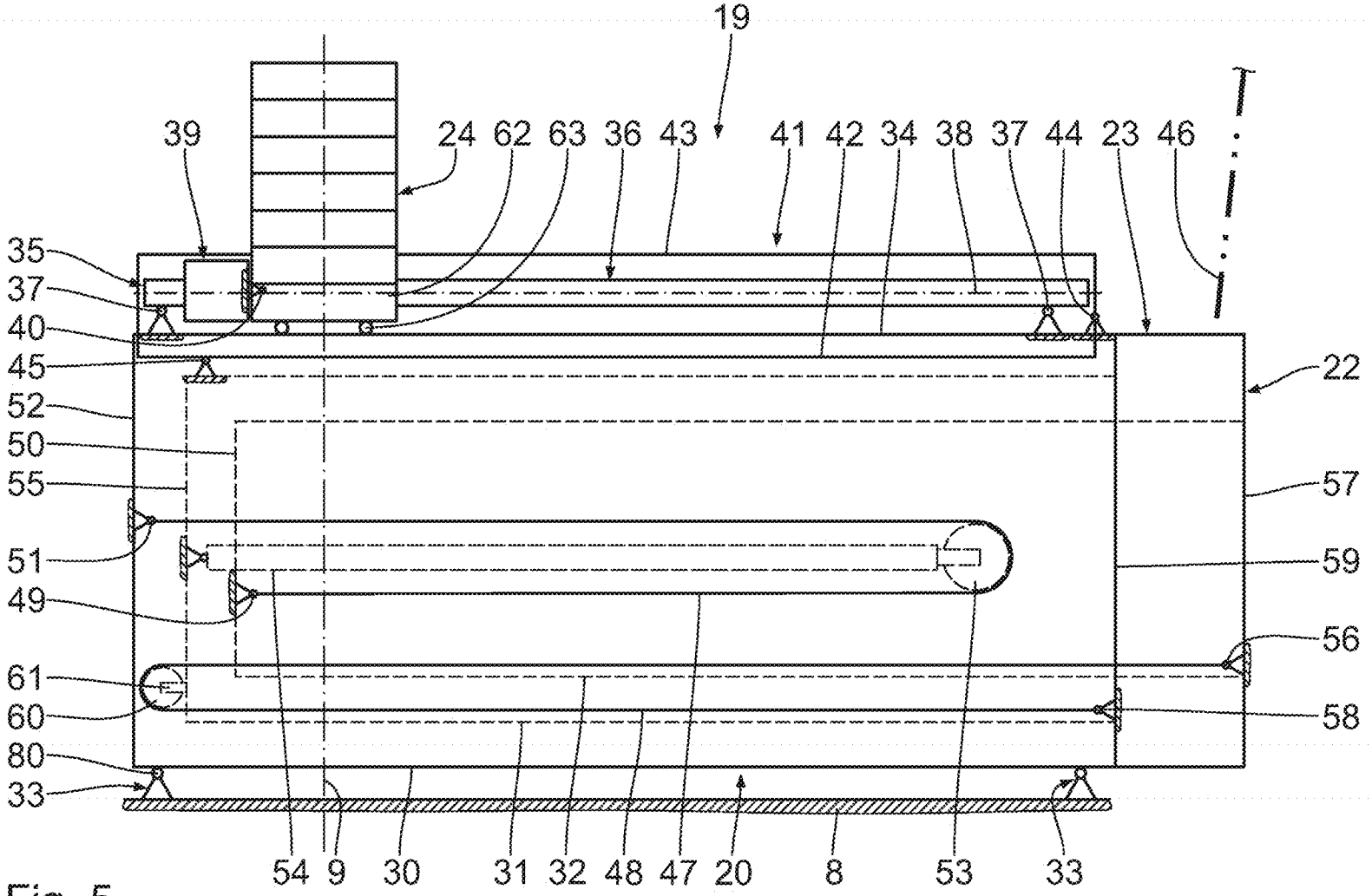
FIG. 5 shows a schematic view of a counterweight adjustment apparatus in accordance with the invention in an arrangement of the counterweight unit with a minimum counterweight radius.
Figure 6:
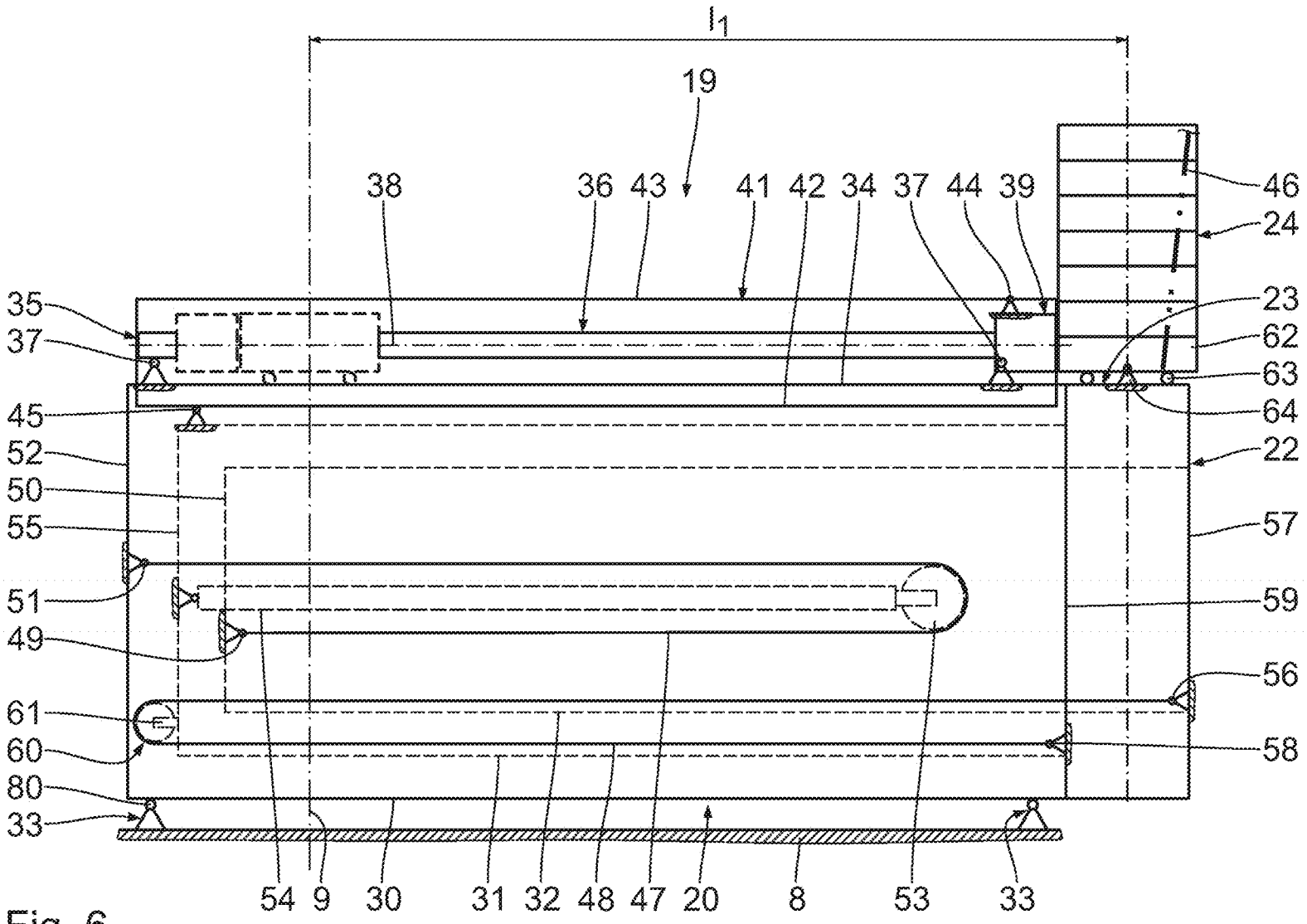
FIG. 6 shows a view, corresponding to FIG. 5, of the counterweight adjustment apparatus with a counterweight unit displaced on the framework.
Figure 7:
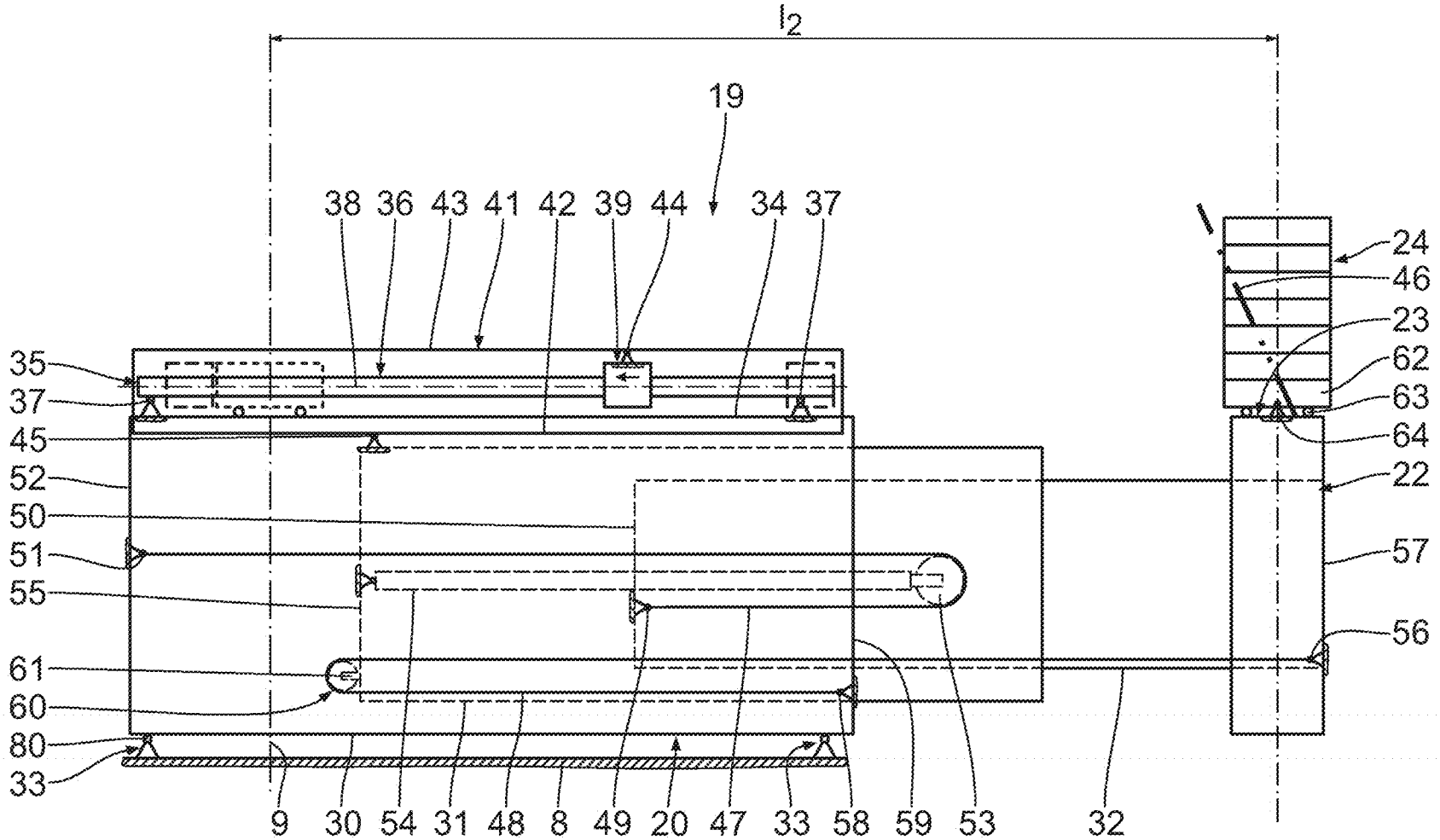
FIG. 7 shows a view, corresponding to FIG. 5, of the counterweight adjustment apparatus in an at least partially telescoped arrangement.

The counterweight adjustment apparatus 19 in accordance with a first exemplified embodiment is explained in greater detail hereinafter in FIGS. 5 to 7. FIGS. 5 to 7 show schematic side views corresponding to FIGS. 1 and 2.

The longitudinal member 22 has an outer basic box 30, a first telescoping element 31 arranged in the basic box 30 and a second telescoping element 32 arranged in the first telescoping element 31. It is also feasible for the longitudinal member 22 to have only one telescoping element or more than two telescoping elements. The telescoping elements 31, 32 can be telescoped in combination with one another with respect to the basic box 30 independently of one another. It is also possible to extend more than one telescoping element and in particular all telescoping elements with respect to the basic box 30. Extension of the telescoping elements can be effected in a coupled manner, in particular simultaneously, or sequentially, i.e. successively in time. The basic box 30 is mounted along the longitudinal axis of the longitudinal member 22 at a front and rear end, i.e. on both sides along the longitudinal axis, on the superstructure by means of a respective bearing 33. The bearing 33 illustrated on the left in FIG. 5 corresponds to the rotary bearing about the axis of rotation 80 which is blocked by the rigid bearing at the rear end of the basic box 30, illustrated on the right in FIG. 5.

In the arrangement of the counterweight unit 24 shown in FIG. 5, it is arranged concentrically with respect to the axis of rotation 9. In this arrangement, the counterweight radius is minimal. The following applies: $r=r_{min}=0$. The minimum counterweight radius $r_{min}$ can also be less than 0. The minimum counterweight radius can also be determined to be greater than 0. This can be determined in particular in dependence upon the structural design of the counterweight unit 24.

It is essential that the foremost position of the counterweight unit 24, which determines the minimum counterweight radius $r_{min}$, is arranged within the tilting edges of the standing base of the crane 1. The tilting edges are defined substantially along a rectangle by the standing surface of the crane, i.e. in particular by the length of the crawler supports and the track width of the crawler supports in a crawler crane.

A guide unit 35 for displacing the counterweight unit 24 in a guided manner is provided on a top side 34 of the longitudinal members 22, in particular of the respective basic box 30. The guide unit 35 has a guide rail 36 which is arranged mounted on the basic box 30 by means of the guide unit bearings 37. The guide rail 36 is linear and specifies a linear guide axis 38. On the guide rail 36, a displacement element 39 can be displaced in a driven manner along the guide axis 38. The displacement element 39 forms a drive unit. The displacement element 39 can be directly coupled to the counterweight unit 24 by means of a coupling element 40. In the coupled arrangement shown in FIG. 5, a displacement of the displacement element 39 along the guide axis 38 directly effects a displacement of the counterweight unit 24. In a decoupled arrangement, the counterweight unit 24 is released from the displacement element 39. A displacement of the displacement element 39 does not effect a displacement of the counterweight unit 24.

According to the exemplified embodiment of the counterweight adjustment apparatus 19, as shown in FIGS. 5 to 7, the kinematic unit 41 has a closed circulating first cable winch system. The first cable winch system comprises a first extension cable 42 which at both ends is connected in each case to the ends of a first return cable 43 at a first connection point 44 and at a second connection point 45. The first connection point 44 is fastened to the top side 34 of the basic box 30. The first connection point is arranged in the region of the guide unit bearing 37 facing the cantilever element 23. The first connection point 44 is arranged adjacent the cantilever element 23.

The second connection point 45 is arranged on the first telescoping element 31. The displacement element 39 can be coupled to the first telescoping element 31 by means of the cable winch system.

In the arrangement shown in FIG. 5, the first cable winch system is decoupled from the displacement element 39.

Figure 18:
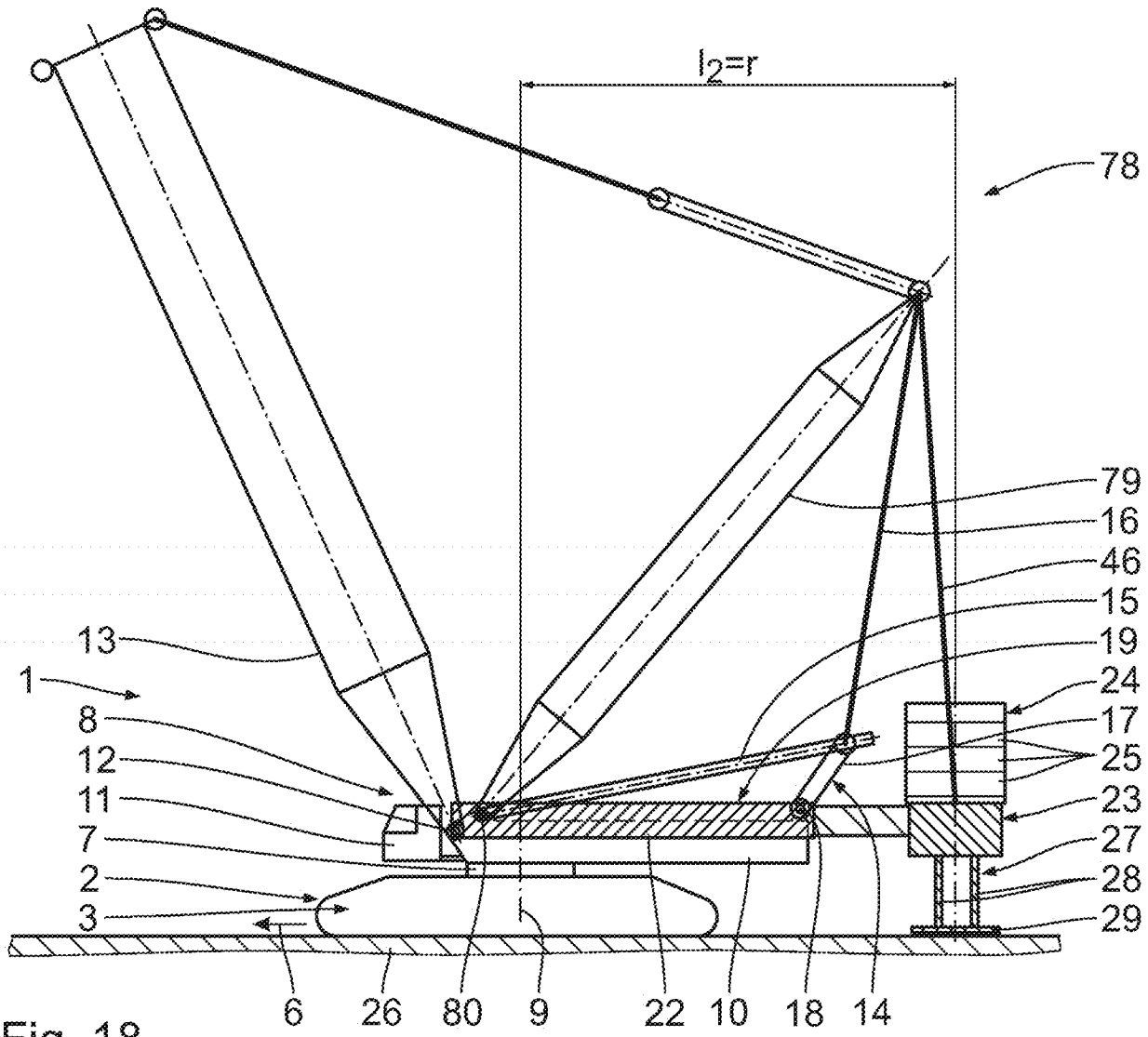
FIG. 18 shows a view, corresponding to FIG. 1, of a crane according to a further embodiment.
Figure 19:
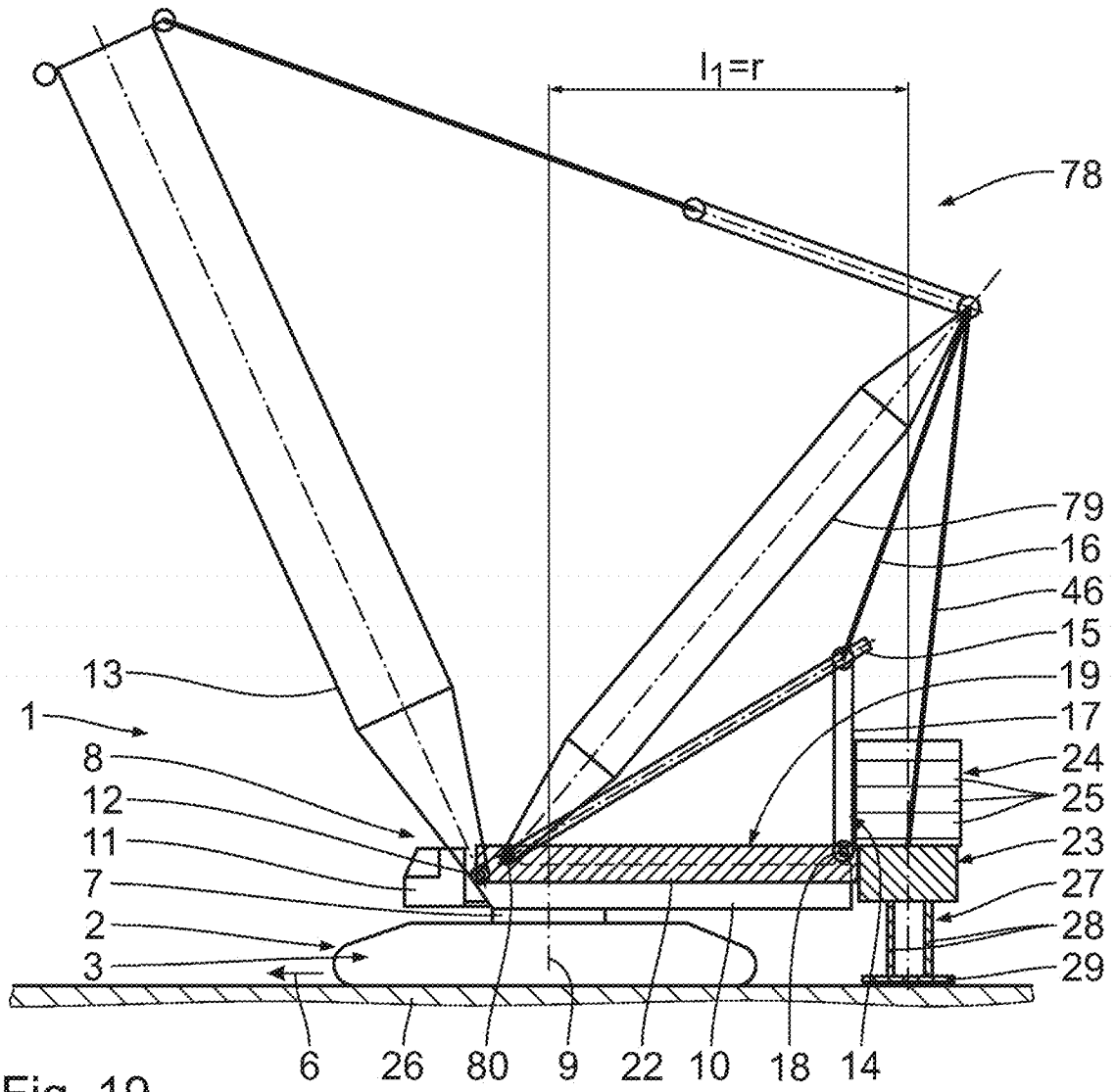
FIG. 19 shows a view, corresponding to FIG. 2, of the crane shown in FIG. 18.

In FIG. 5, a connection line 46 indicates a bracing of the cantilever element 23 to a tip of a superlift mast of a crane, not illustrated in FIGS. 1 and 2. A crane 78 comprising a superlift mast 79 is shown in FIGS. 18, 19.

The kinematic unit 41 also has a second cable winch system. The second cable winch system has an open design and has a second extension cable 47 and a second return cable 148. The cables 47, 48 are not connected to one another. A first end 49 of the second extension cable 47 is fastened to a rear wall 50 of the second telescoping element 32 remote from the cantilever element 23. A second end 51 of the second extension cable 47 is fastened to a rear wall 52 of the basic box 30 remote from the cantilever element 23. The second extension cable 47 is guided via an extension cable deflecting roller 53 which is arranged mounted in a rotatable manner on an extension cable deflecting roller beam 54. The extension cable deflecting roller beam 54 is fastened to a rear wall 55 of the first telescoping element 31 remote from the cantilever element 23.

A first end 56 of the second return cable 48 is fastened to a rear wall 57 of the cantilever element 23 remote from the longitudinal member 22. A second end 58 of the second return cable 48 is fastened to an end face 59 of the basic box 30 facing the cantilever element 23. The second return cable 148 is guided about a rotatably mounted return cable deflecting roller 60. The return cable deflecting roller 60 is fastened to the rear wall 55 of the first telescoping element 31 by means of a return cable deflecting roller beam 61.

A method for adjusting a counterweight, in particular the counterweight unit 24, will be explained hereinafter with reference to FIGS. 5 to 7.

In the arrangement shown in FIG. 5, the counterweight unit is arranged with a minimum counterweight radius of e.g. $r_{min}=0$. In this arrangement, the counterweight unit 24 is coupled to the displacement element 39 by means of the coupling element 40.

The displacement unit 39 is displaced along the guide axis 38.

As a result, the counterweight unit 24 is directly displaced in a manner guided along the guide unit 35, in particular from the axis of rotation 9 in the direction of the cantilever element 23. In a maximum-displaced arrangement shown in FIG. 6, the displacement unit 39 is arranged on an end of the guide unit 35 facing the cantilever element 23. The counterweight unit 24 is arranged on the cantilever element 23. In this arrangement, the counterweight radius r corresponds to the length b as shown in FIG. 1. In this arrangement, the coupling between the counterweight unit 24 and the displacement element 39 is disengaged. The coupling element 40 can be used for coupling the displacement element 39 to the first cable winch system, in particular at the first connection point 44.

The counterweight unit 24 is locked to the cantilever element 23 by means of a locking unit 64. To this end, the counterweight unit 24 has a locking element which cooperates with a locking counter-element of the cantilever element 23. In the locked arrangement shown in FIG. 6, the counterweight unit 24 is fastened reliably and securely to the cantilever element 23.

Subsequently, the displacement element 39 is displaced back to the initial position shown in FIG. 5, i.e. in the direction of the rear wall 52 of the basic box 30. This return displacement is illustrated in FIG. 7. When the displacement element 39 is being displaced back, it entrains the cable winch system therewith at the second connection point 44. At the same time, the second connection point 45 which is fastened directly to the cable winch system is also entrained The entrained connection point 45 effects a linear displacement of the first telescoping element 31. By means of the first telescoping element 31, the extension cable deflecting roller beam 54 is displaced with the extension cable deflecting roller 53. As a result, the cable portion of the second extension cable 47 which is arranged between the first end 49 and the extension cable deflecting roller 53 is shortened. As a result, the second telescoping element 32 is also extended. The telescoping according to the exemplified embodiment of the counterweight adjustment apparatus 19 is effected in a dependent manner, which means that the two telescoping elements 31, 32 extend at the same time, wherein the extension speed of the cantilever element 23 corresponds to 1.5 times the speed of the displacement element 39. The counterweight unit 24 is telescoped with the cantilever element 23. The counterweight radius can thereby be substantially increased to b. In particular, the maximum counterweight radius $r_{max}$ is a multiple, in particular at least 1.5 times, in particular at least two times, in particular at least 2.5 times and in particular at least 3 times the length $l_1$.

The counterweight adjustment apparatus is telescoped inwards in a correspondingly reversed sequence. Displacing the adjustment element 39 back to the position shown in FIG. 6 ensures, by reason of the coupling at the first connection point 44, that the first return cable 43 is pulled towards the cantilever element 23. The first telescoping element 31 is pulled into the basic box by means of the return cable 43 and the second connection point 45. Together with the telescoping element 31, the return cable deflecting roller 60 which is fastened thereto is also telescoped inwards and so the portion of the second return cable 48, which is fastened between the return cable deflecting roller 60 and the first end 56 to the rear wall 57 of the cantilever element 23, is shortened. The second telescoping element is automatically retracted.

Figure 8:
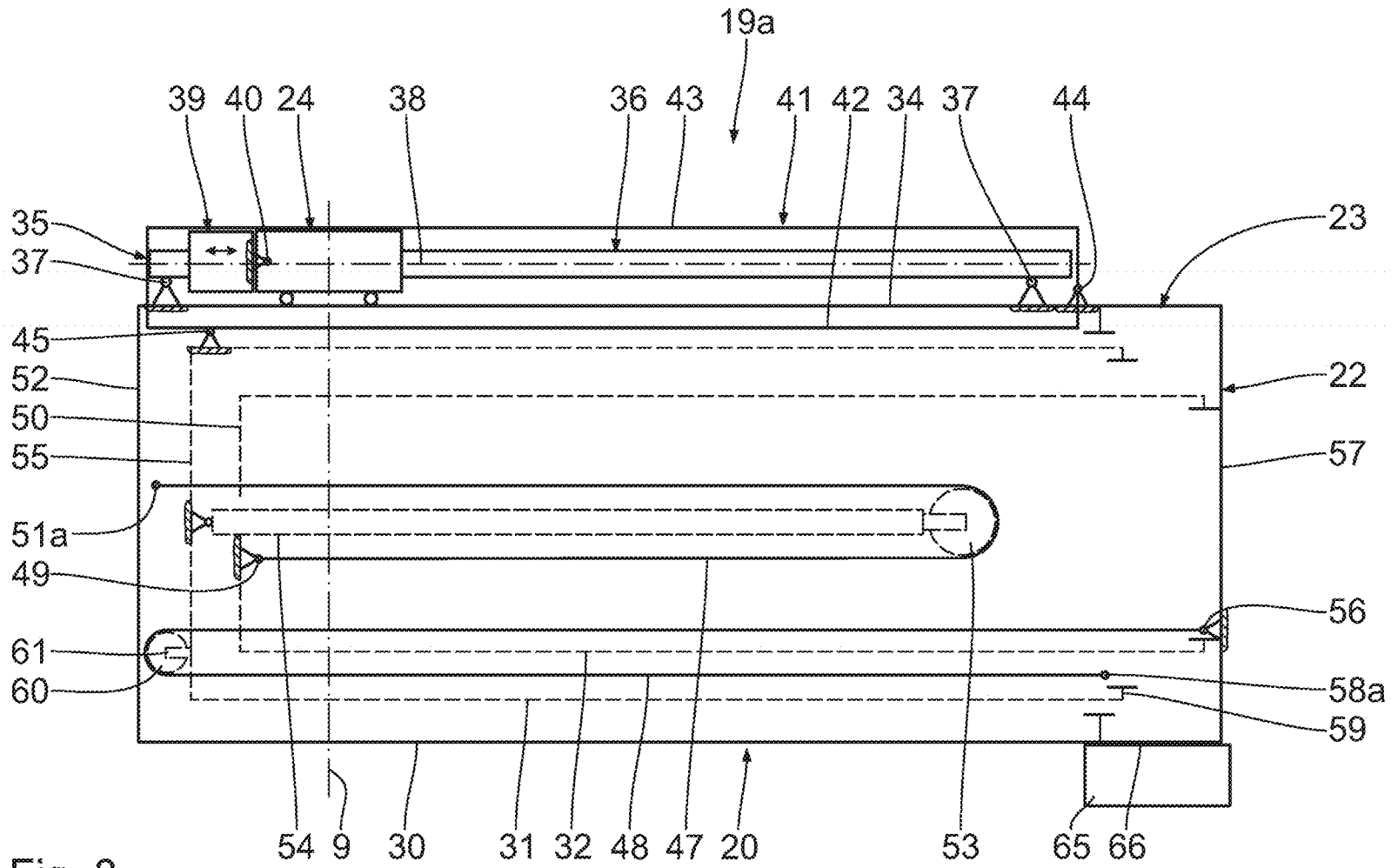
FIG. 8 shows a view, corresponding to FIG. 5, of a counterweight adjustment apparatus according to a further embodiment.
Figure 9:
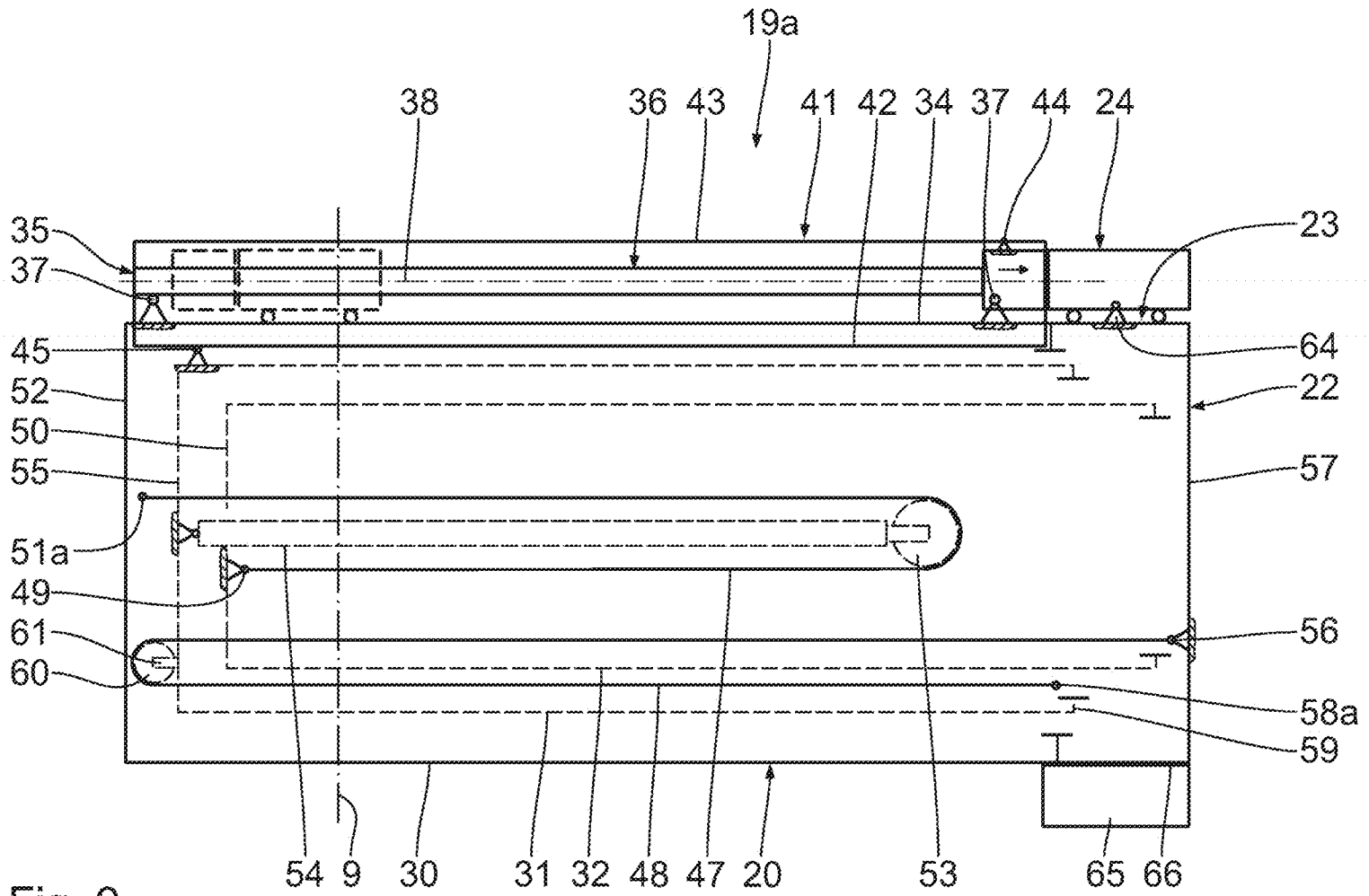
FIG. 9 shows a view, corresponding to FIG. 6, of the counterweight adjustment apparatus shown in FIG. 8.
Figure 10:
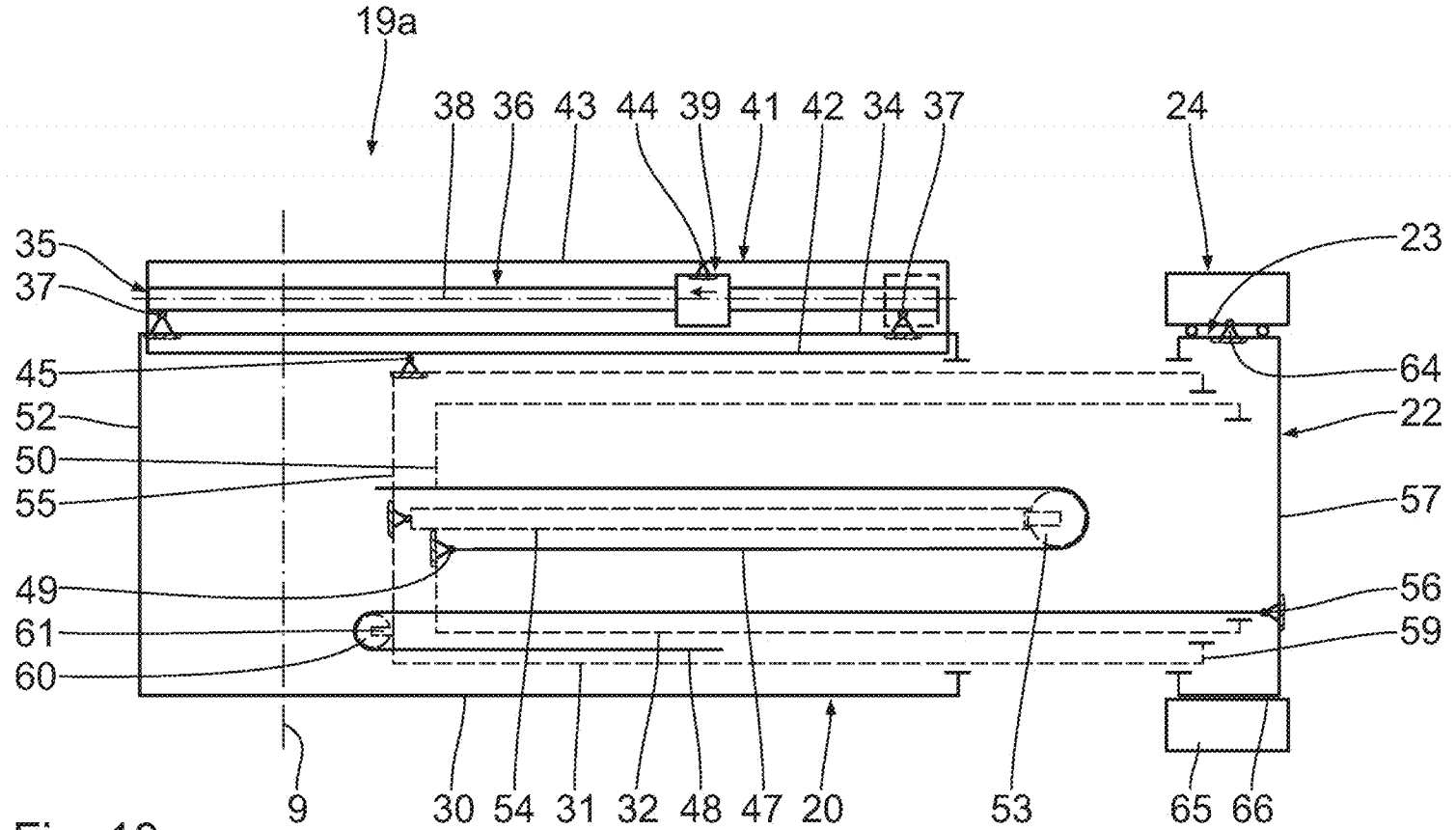
FIG. 10 shows a view, corresponding to FIG. 7, of the counterweight adjustment apparatus shown in FIG. 8.

A further embodiment of the invention will be described hereinafter with reference to FIGS. 8 to 10. Structurally identical parts are designated by the same reference signs as in the first embodiment, the description of which is hereby referred to. Structurally different but functionally similar parts are designed by the same reference signs suffixed by the letter a.

The substantial difference in the counterweight adjustment apparatus 19*a* is that an additional cantilever element counterweight 65 is provided. By reason of the additional cantilever element counterweight 65, the mass and in particular the stacking height of the counterweight elements 25 of the counterweight unit 24 can be reduced. By virtue of the fact that the counterweight unit 24 which is to be displaced along the longitudinal member 22 is reduced in terms of weight, the longitudinal members, in particular the basic box 30 and the telescoping elements 31 and 32 arranged therein can be dimensioned smaller, i.e. can have a smaller construction. In particular, it is feasible to reduce the number of counterweight elements 25.

The cantilever element counterweight 65 is fastened to an underside 66 of the cantilever element 23. By reason of the off-centre, i.e. eccentric in relation to the axis of rotation 9, arrangement of the cantilever element counterweight 65, the counterweight adjustment apparatus 19*a* according to this embodiment in the arrangement shown in FIG. 8 already has an effective counterweight radius $r_{eff}$ which has a non-zero value, although the counterweight unit 24 is arranged concentrically to the axis of rotation 9.

It is possible to arrange the counterweight adjustment apparatus 19*a* on the superstructure 8 and to fasten it thereto such that the counterweight unit 24 is arranged, in relation to the axis of rotation 9, opposite the cantilever element counterweight 65 in order to produce an effective counterweight radius of $r_{eff}=0$.

A further difference in comparison with the first embodiment is that neither the second end 51*a* of the second extension cable 47 nor the second end 58*a* of the second return cable 48 are fastened. During actuation of the counterweight adjustment apparatus 19*a* by displacing the displacement element 39 with a coupled kinematic unit 41, only the first telescoping element 31 is telescoped. The second telescoping element 32 is telescoped together with the first telescoping element 31. However, the second telescoping element 32 is not adjusted with respect to the first telescoping element 31.

A further embodiment of the invention will be described hereinafter with reference to FIGS. 11 to 17. Structurally identical parts are designated by the same reference signs as in the first embodiments, the description of which is hereby referred to. Structurally different but functionally similar parts are designated by the same reference signs suffixed by the letter b.

The substantial difference compared with the previous embodiments is that in the case of the counterweight adjustment apparatus 19*b* the drive unit has a rotating element 68 which is rotatably driven about an axis of rotation 67. In particular, the rotating element 68 is a gearwheel.

The rotating element 68 can be driven in a rotatable manner in relation to the axis of rotation 67 in particular in both directions of rotation.

The rotating element 68 can be displaced in a coupling direction 69 which is oriented perpendicularly to the axis of rotation 67. According to the exemplified embodiment shown, the coupling direction 69 is linear and in particular vertical. It is essential that a displacement of the rotating element 68 in the coupling direction 69 permits an arrangement in a first position shown in FIG. 11 and an arrangement in a second position shown in FIG. 12. In the first position shown in FIG. 11, the rotating element is coupled to a first force transmission element 70 of the drive unit. The first force transmission element is designed as a circulating roller chain which is guided in a circulating manner on two gearwheels 71. In a second position of the rotating element 68 shown in FIG. 12, the rotating element 68 is coupled to a second force transmission element 72. The second force transmission element 72 is designed as a circulating roller chain. The second force transmission element 72 is preferably identical to the first force transmission element 70.

The roller chain of the first force transmission element 70 is used at the same time as a guide unit 35*b* for the guided displacement of the counterweight unit 24. Fastened to the first force transmission element 70 is the coupling element 40*b*, by means of which the counterweight unit 24 can be fastened directly to the first force transmission element 70. The gearwheels 71, about which the first force transmission element 70 is guided, is rotatably mounted on the top side 34 of the basic box 30. The first telescoping element 31 can be coupled to the basic box 30 by means of a first telescoping-coupling apparatus 73. In a coupled arrangement, the first telescoping element 31 is locked on the basic box 30.

The second telescoping element 32 can be coupled to the first telescoping element 31 by means of a second telescoping-coupling apparatus 74. In a coupled arrangement, the second telescoping element 32 is fastened to the first telescoping element 31.

The second force transmission element 72, i.e. the roller chain, is guided in a circulating manner over gearwheels 71. The gearwheels 71 are each fastened at the end face to a gearwheel carrier 75. The gearwheel carrier 75 is fastened to the rear wall 52 of the basic box 30. The second force transmission element 72 corresponds to the kinematic unit 41*b* for this exemplified embodiment.

Figure 11:
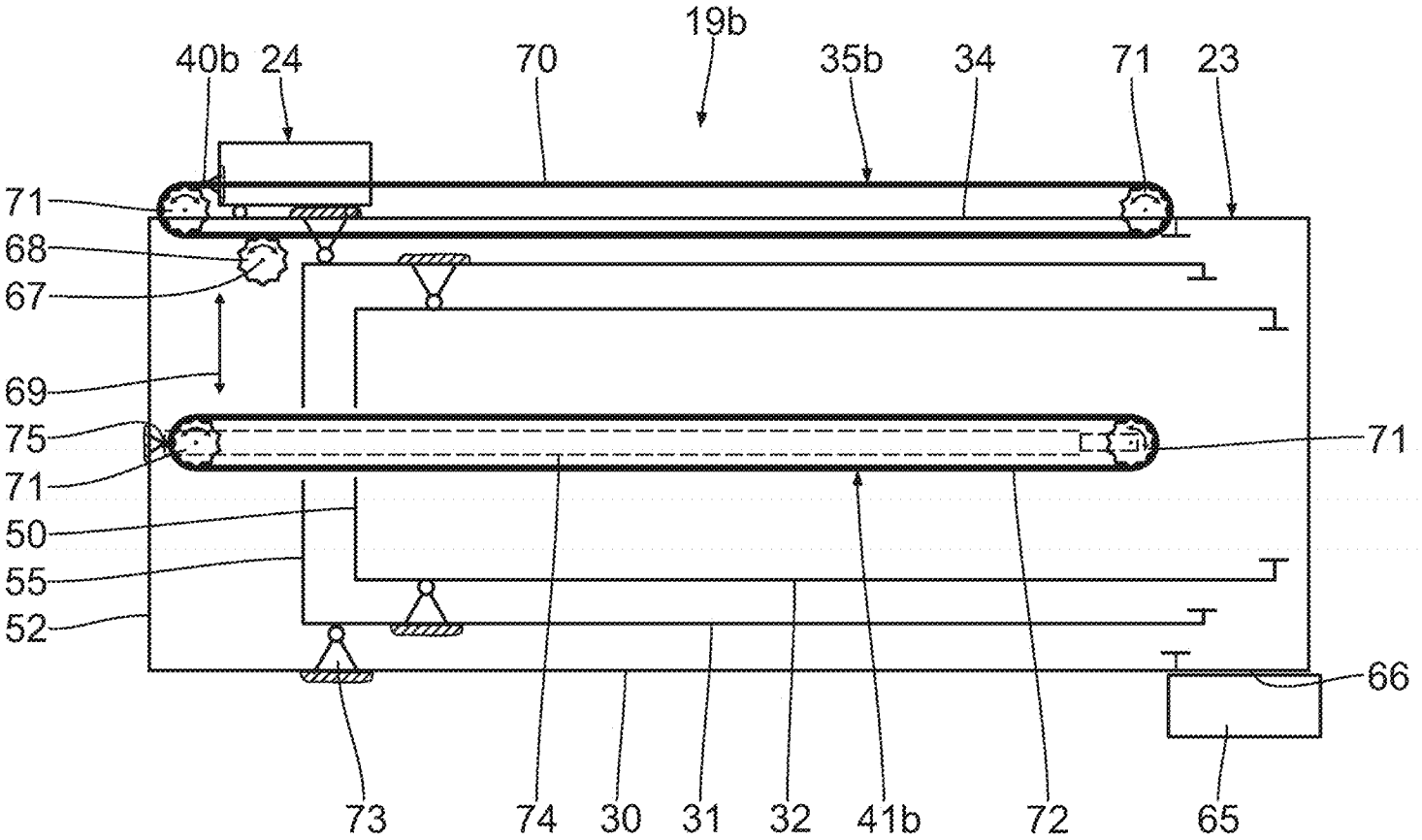
FIG. 11 shows a view, corresponding to FIG. 5, of the counterweight adjustment apparatus according to a further embodiment.

The method for displacing the counterweight unit 24 with the counterweight adjustment apparatus 19*b* will be explained in greater detail hereinafter with reference to FIGS. 11 to 17. Initially, the rotating element 68 shown in FIG. 11 is rotatably driven clockwise about the axis of rotation 67. As a result, the roller chain 70 is driven clockwise about the gearwheels 71 and, as shown in FIG. 11, the counterweight unit 24 is displaced by means of the coupling element 40*b* from left to right towards the cantilever element 23. In the arrangement shown in FIG. 12, the counterweight unit 24 is decoupled from the first force transmission element 70 and is coupled on the cantilever element 23 by means of the locking unit 64.

Figure 12:
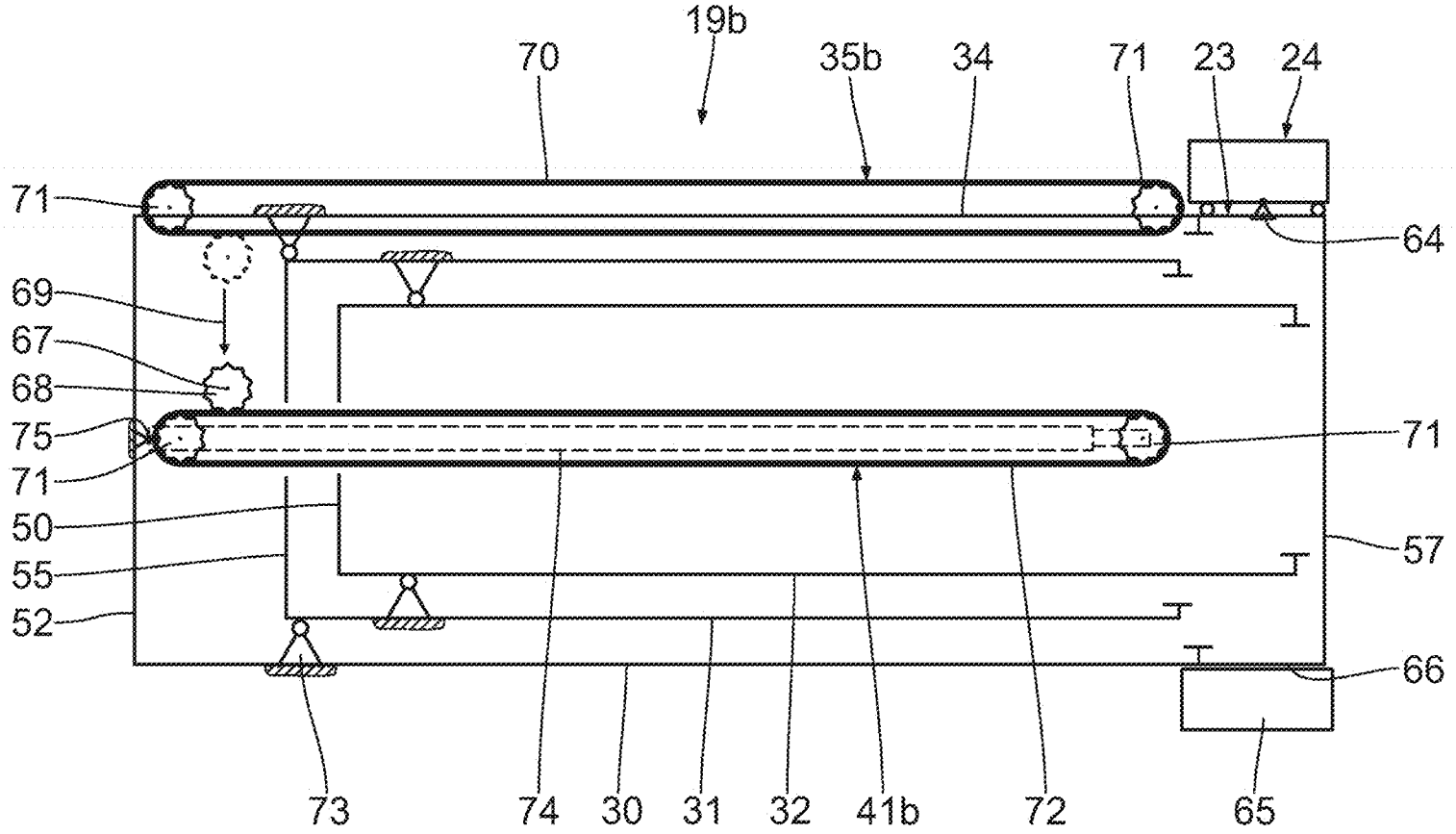
FIG. 12 shows a view, corresponding to FIG. 11, wherein a rotating element is displaced in a coupling direction for coupling to the kinematic unit.

The rotating element 68 is displaced downwards in the coupling direction 69 until the rotating element 68 is in engagement with the second force transmission element 72 (FIG. 12).

Figure 13:
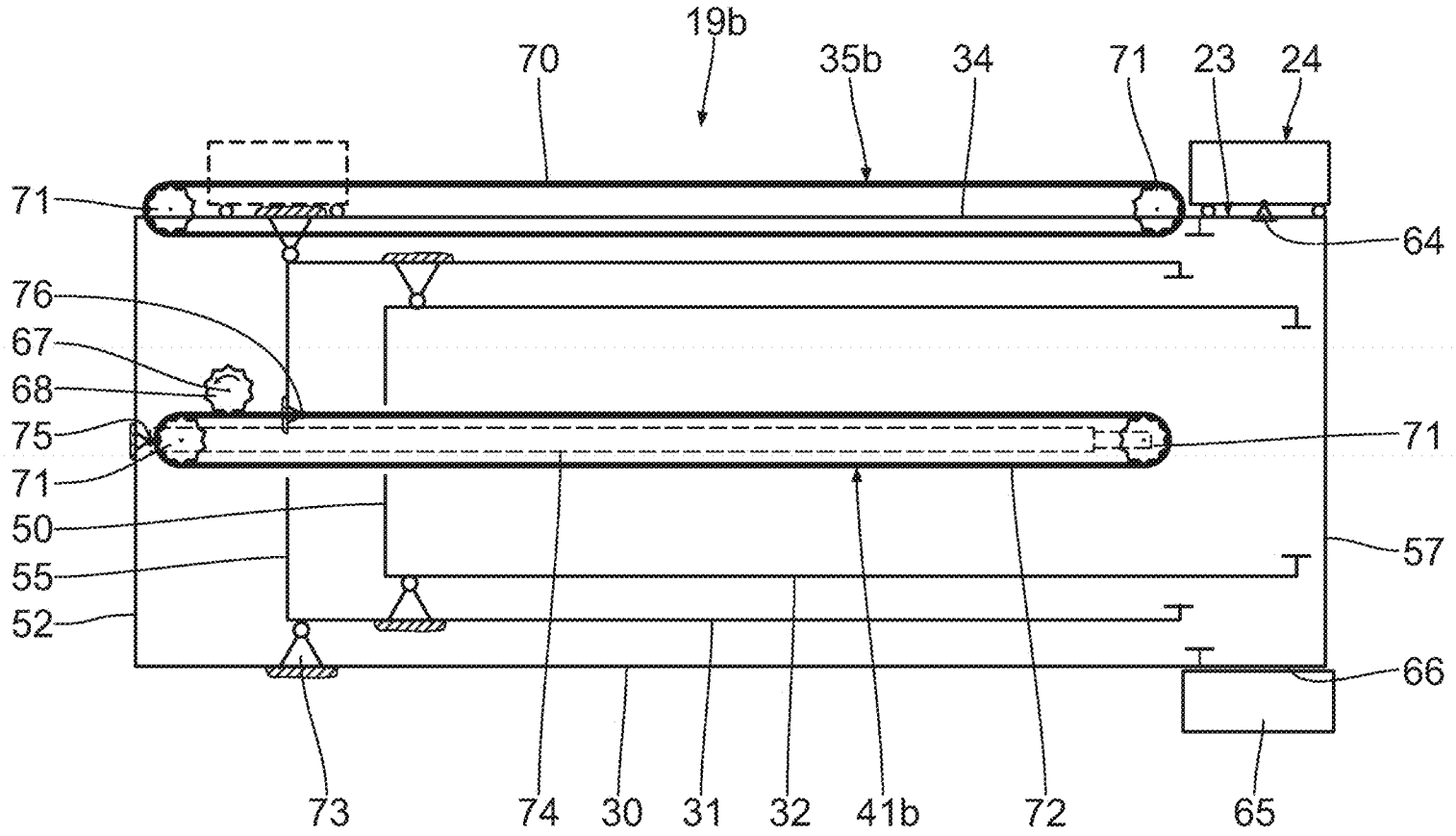
FIG. 13 shows a view, corresponding to FIG. 6, of the counterweight adjustment apparatus shown in FIG. 11.
Figure 14:
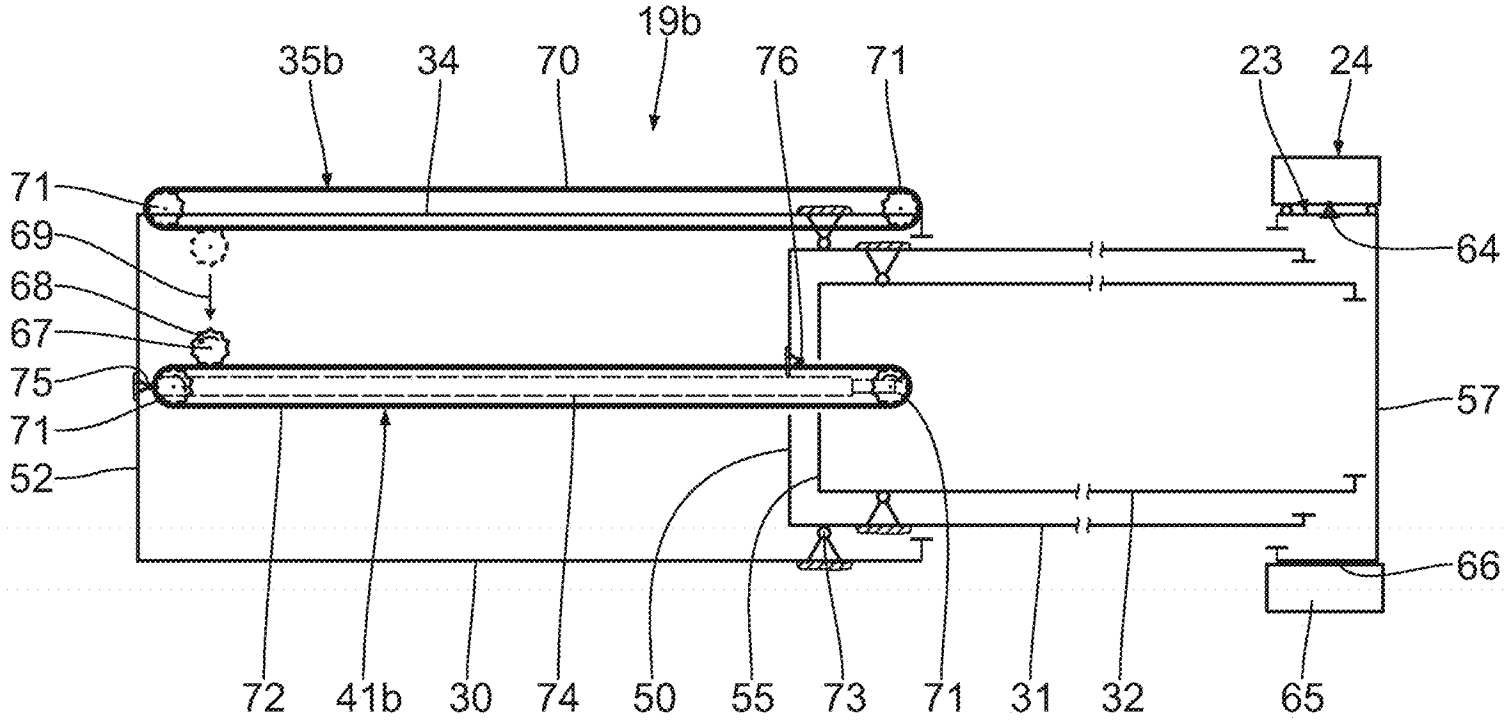
FIG. 14 shows a view, corresponding to FIG. 7, of the counterweight adjustment apparatus with single telescoping.

Subsequently, the rotating element 68 in the view in FIG. 13 is rotatably driven counter-clockwise about the axis of rotation 67. At the same time, the second force transmission element 72 is coupled to the first telescoping element 31 by means of a first force transmission element/coupling element 76. The first telescoping element 31 is telescoped outwards by virtue of the rotational driving movement of the rotating element 68 which is transmitted to the force transmission element 72. A state of the first telescoping element 31 in which it is telescoped outwards to the maximum extent with respect to the basic box 30 is illustrated in FIG. 14. Together with the first telescoping element 31, the second telescoping element 32 and the cantilever arm 23 fastened thereto are telescoped outwards. Inwards telescoping is effected in a correspondingly reversed sequence.

Figure 15:
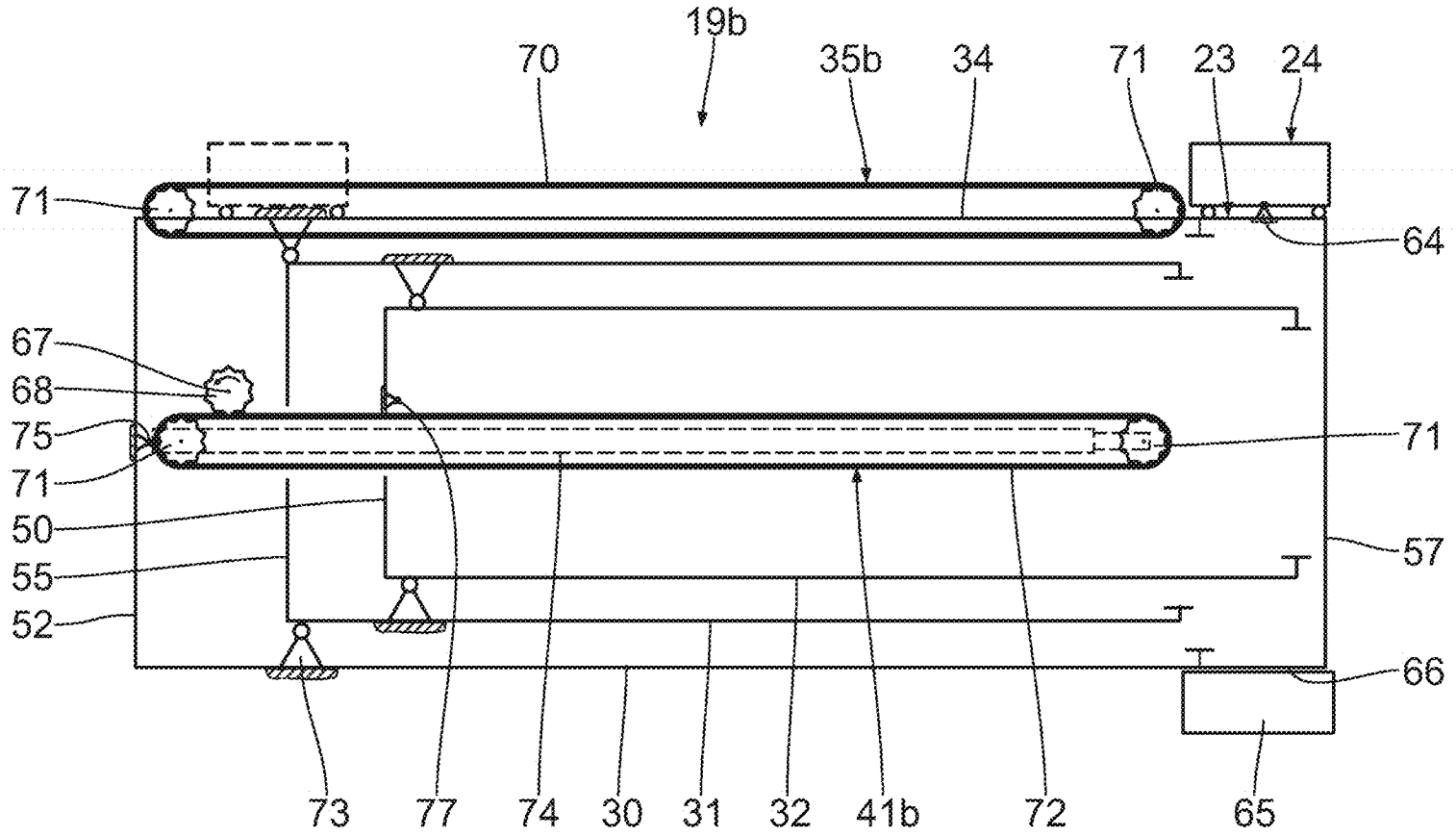
FIG. 15 shows a view, corresponding to FIG. 13, of the counterweight adjustment apparatus with double telescoping in a first telescoping stage.
Figure 16:
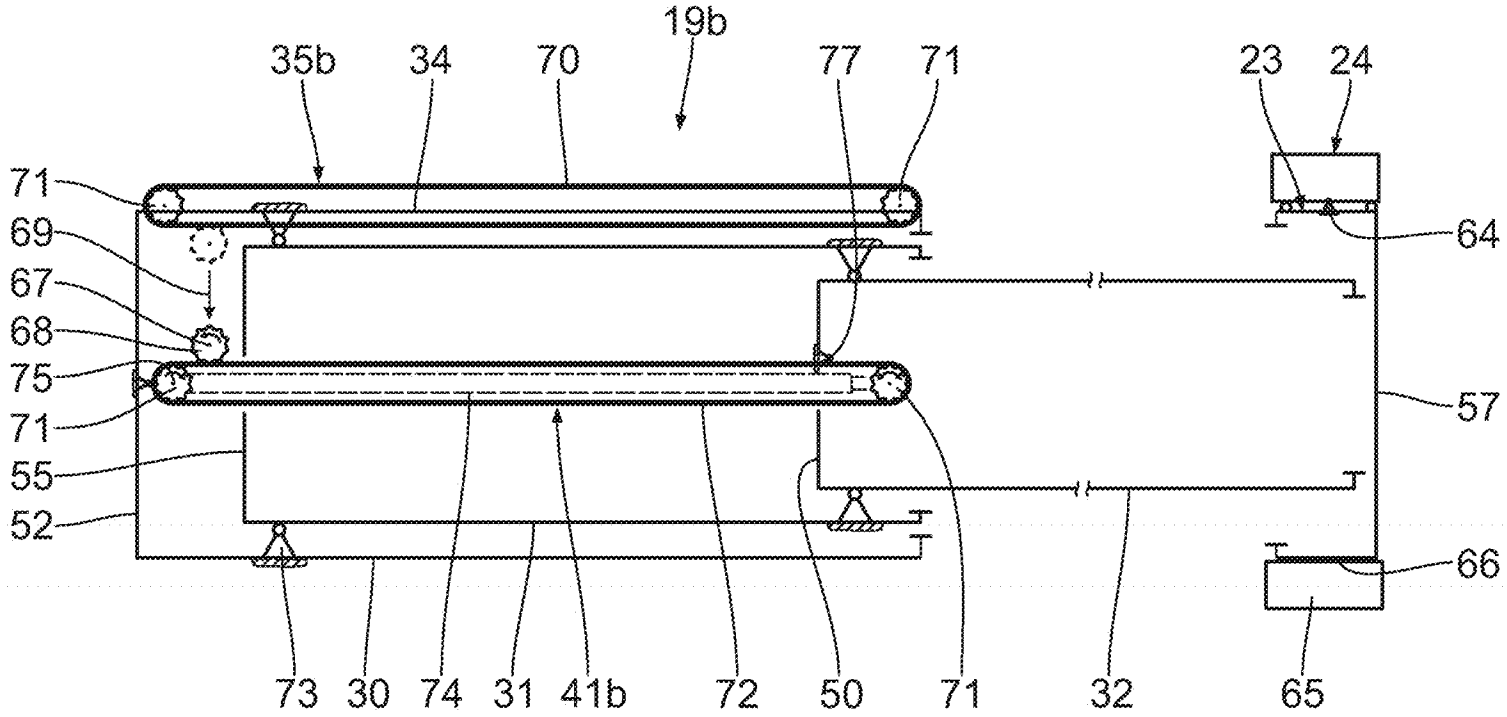
FIG. 16 shows a view, corresponding to FIG. 15, of the counterweight adjustment apparatus with double telescoping for preparing a second telescoping stage.

Alternatively, it is also possible, proceeding from the arrangement in FIG. 13, to couple a second force transmission element/coupling element 77 to the second force transmission element 72 in order to enable the second telescoping element 32 to telescope outwards. FIGS. 15 and 16 illustrate the second telescoping element 32 telescoping outwards.

Figure 17:
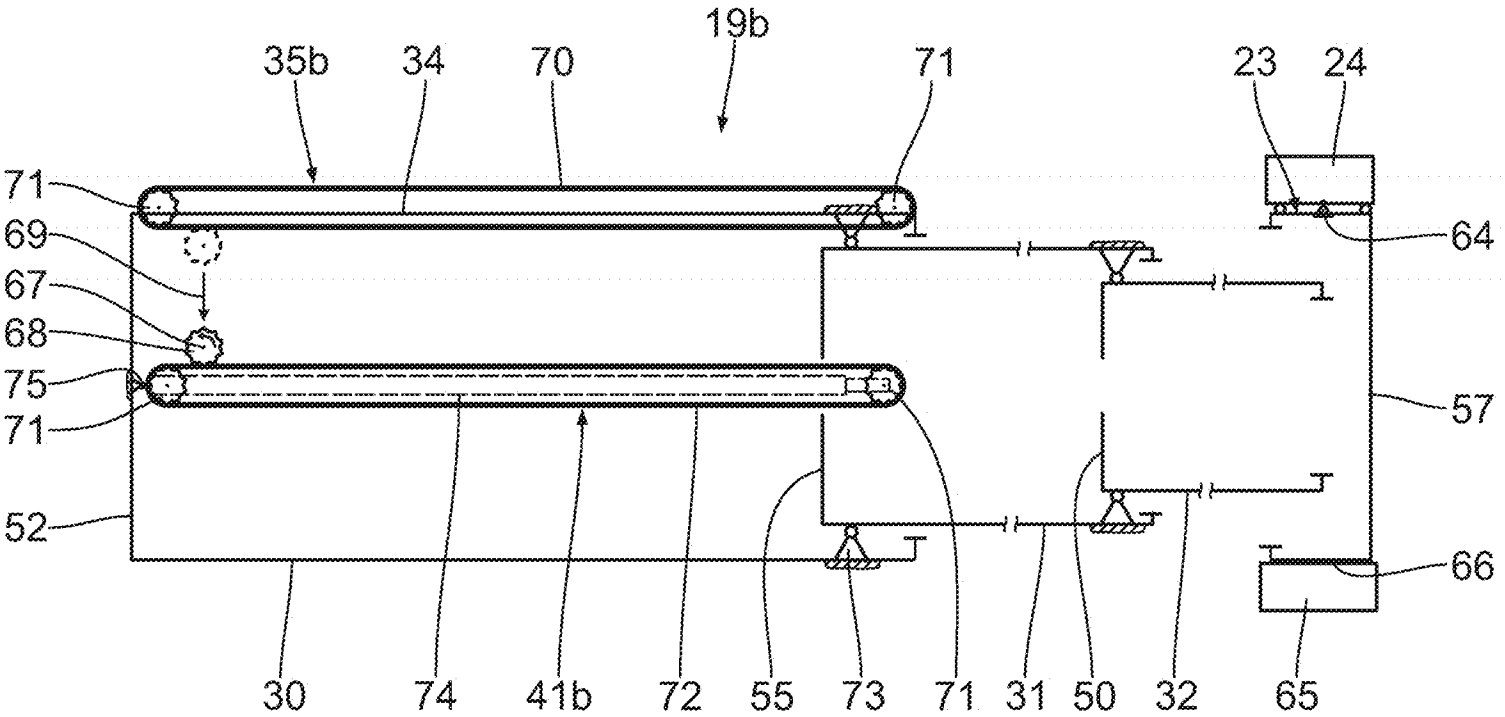
FIG. 17 shows a view, corresponding to FIG. 16, after completion of the second telescoping stage.

It is also feasible to perform the procedure in a staggered manner, in particular in succession, i.e. in that e.g. initially the inner second telescoping element 32 is extended as shown in FIG. 16 in order subsequently to extend the inner telescoping element 31 by coupling to the first force transmission element/coupling element 76. A twice-extended, maximum telescoped state of the counterweight adjustment apparatus 19*b* is illustrated in FIG. 17. Inwards telescoping is effected in a correspondingly reversed procedure.

A further embodiment of a crane 78 will be described hereinafter with reference to FIGS. 18 and 19. Structurally identical parts 25 are designated by the same reference signs as in the first embodiment, the description of which is hereby referred to.

The substantial difference with respect to the crane shown in FIGS. 1 to 4 is that the crane 78 is a superlift crane which has a superlift mast which is pivotably articulated to the superstructure 8 in a manner known per se and is braced to the superstructure by means of a bracing element 14. In addition, bracing 46 is provided from the head of the superlift mast 79 to the cantilever element 23. The bracing 46 can be coupled preferably in the centre of gravity of the counterweight unit 24. Coupling outside the centre of gravity is possible.

Moreover, the counterweight adjustment apparatus 19 in the case of the crane 78, i.e. during the superlift operation, is coupled at the rear end non-rigidly to the superstructure 8. This permits rotatability of the counterweight adjustment apparatus 19 about the axis of rotation 80, which is in parallel with the pivot axis 12, at the front end of the counterweight adjustment apparatus 19.

Coupling between the superstructure 8 and the longitudinal member 22 can be advantageous.

The A-bracket 15 is connected to the tip of the superlift mast 79 by means of the cable reeving 16. The triangle formed by the A-bracket 15, the reeving 16 and the superlift mast 79 is rigid. The triangle is articulated to the superstructure 8 of the crane 78 so as to be able to rotate about the axis of rotation 80. Since said triangle 15, 16, 79 is rigid, the cable reeving 14 between the superstructure 8 of the crane 78 and the A-bracket 15 is also rigid, i.e. not variable in length. The bracing 56 of the counterweight unit 24 on the superlift mast 79 is formed in particular by support rods which have a constant length. During a displacement of the counterweight unit 24 by means of the cantilever element 23, the counterweight unit 24 is displaced non-linearly, in particular along an arc segment. In order to ensure support on the ground, the vertical supports 28 can be height-adjustable. The height-adjustability can also be used for compensating for height differences in the standing surface of the crane 78 under the base plate 29. In addition or alternatively, the support rods of the brace 46 can also be variable in length in order to permit a displacement of the counterweight unit 24 in a linear direction.

The invention claimed is:

1. A crane comprising:

a lower carriage, a superstructure which can be pivoted about an axis of rotation with respect to the lower carriage, a counterweight unit and a counterweight adjustment apparatus, wherein the counterweight adjustment apparatus comprises:

a telescopic framework which is fastened to the superstructure and has a telescopic longitudinal member, the counterweight unit which is arranged so as to be displaceable along the framework, a drive unit for displacing the counterweight unit in a driven manner on the framework, and a kinematic unit which can be coupled to the drive unit in order to telescope the framework in a driven manner, wherein a cantilever element is fastened to a rear end of the longitudinal member remote from the axis of rotation, the counterweight unit can be displaced along the framework in the region of the superstructure as far as onto the cantilever element, the counterweight unit can be fastened to the cantilever element and the counterweight unit can be telescoped inwards and outwards on the cantilever element with the framework, further comprising a guide unit which is arranged on the longitudinal member for displacing the counterweight unit in a guided manner in the region of the superstructure, wherein the drive unit is a displacement unit which is driven along the guide unit, and wherein the kinematic unit has a first cable winch system which can be connected to the displacement unit, wherein the first cable winch system can be coupled to a first telescoping element of the longitudinal member.

2. The crane as claimed in claim 1, further comprising two longitudinal members which are arranged symmetrically, in parallel, and spaced apart with respect to a longitudinal axis of the framework.

3. The crane as claimed in claim 1, further comprising a locking unit for locking the counterweight unit on the cantilever element.

4. The crane as claimed in claim 1, further comprising an additional cantilever element counterweight which is anchored to the cantilever element, wherein the additional cantilever element counterweight is anchored to an underside of the cantilever element.

5. The crane as claimed in claim 1, wherein the kinematic unit has a second cable winch system which is fastened to the first telescoping element and connects a basic box of the longitudinal member to a second telescoping element arranged in the first telescoping element.

6. The crane as claimed in claim 1, wherein the drive unit has a rotating element which is driven so as to be able to rotate about an axis of rotation, and a first force transmission element which can be connected to the rotating element, wherein the first force transmission element can be coupled to the counterweight unit.

7. The crane as claimed in claim 6, wherein the rotating element can be displaced in a coupling direction, perpendicularly to the axis of rotation, for coupling to the kinematic unit.

8. The crane as claimed in claim 6, wherein the kinematic unit has a second force transmission element which can be connected to the rotating element, wherein the second force transmission element can be coupled to a basic box or to a second telescoping element arranged in a first telescoping element, and wherein the rotating element can be coupled to the second force transmission element in order to telescope the framework.

9. A method for adjusting a counterweight unit on a crane comprising a lower carriage, a superstructure which can be pivoted about an axis of rotation with respect to the lower carriage, and a counterweight adjustment apparatus, wherein the counterweight adjustment apparatus comprises a telescopic framework which is fastened to the superstructure and has a telescopic longitudinal member, the counterweight unit which is arranged so as to be displaceable along the framework, a drive unit for displacing the counterweight unit in a driven manner on the framework, and a kinematic unit which can be coupled to the drive unit in order to telescope the framework in a driven manner on a crane, wherein the crane further comprises a guide unit which is arranged on the longitudinal member for displacing the counterweight unit in a guided manner in the region of the superstructure, wherein the drive unit is a displacement unit which is driven along the guide unit, and wherein the kinematic unit has a first cable winch system which can be connected to the displacement unit, wherein the first cable winch system can be coupled to a first telescoping element of the longitudinal member, the method comprising:

displacing in a first step the counterweight unit along the framework in the region of the superstructure as far as onto a cantilever element arranged at the rear end of the longitudinal member remote from the axis of rotation and fastening the counterweight unit at this location; and telescoping the counterweight unit in a second step in relation to the superstructure inwards and outwards on the cantilever element with the framework via the drive unit.

10. The method of claim 9, wherein the crane further comprises two longitudinal members which are arranged symmetrically, in parallel, and spaced apart with respect to a longitudinal axis of the framework.

11. The method of claim 9, wherein the crane further comprises an additional cantilever element counterweight which is anchored to the cantilever element, wherein the additional cantilever element counterweight is anchored to an underside of the cantilever element.

12. The method of claim 9, wherein the kinematic unit has a second cable winch system which is fastened to the first telescoping element and connects a basic box of the longitudinal member to a second telescoping element arranged in the first telescoping element.

13. The method of claim 9, wherein the drive unit has a rotating element which is driven so as to be able to rotate about an axis of rotation, and a first force transmission element which can be connected to the rotating element, wherein the first force transmission element can be coupled to the counterweight unit.

* * * * *